US006799831B2

(12) United States Patent
Inamoto et al.

(10) Patent No.: US 6,799,831 B2
(45) Date of Patent: Oct. 5, 2004

(54) LIQUID DISCHARGE RECORDING HEAD AND METHOD FOR MANUFACTURING THE SAME

(75) Inventors: Tadayoshi Inamoto, Tokyo (JP); Haruhiko Terai, Kanagawa (JP); Hiroyuki Yamamoto, Kanagawa (JP); Yoshiaki Kurihara, Kanagawa (JP); Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/237,103

(22) Filed: Sep. 9, 2002

(65) Prior Publication Data

US 2003/0048328 A1 Mar. 13, 2003

(30) Foreign Application Priority Data

Sep. 12, 2001 (JP) ..... 2001-276757

(51) Int. Cl.[7] ..... B41J 2/135
(52) U.S. Cl. ..... 347/44
(58) Field of Search ..... 347/44, 20, 47, 347/40, 43, 42, 84, 85, 86, 89, 90, 21, 54, 55, 68, 71, 87

(56) References Cited

U.S. PATENT DOCUMENTS

| | | | |
|---|---|---|---|
| 4,509,063 | A | 4/1985 | Sugitani et al. |
| 4,521,787 | A | 6/1985 | Yokota et al. |
| 4,666,823 | A | 5/1987 | Yokota et al. |
| 4,675,083 | A | 6/1987 | Bearss et al. |
| 4,698,645 | A | 10/1987 | Inamoto |
| 5,126,768 | A | 6/1992 | Nozawa et al. |
| 5,218,376 | A | 6/1993 | Asai |
| 5,685,074 | A | 11/1997 | Pan et al. |
| 5,774,150 | A | 6/1998 | Kobayashi et al. |
| 5,808,641 | A | 9/1998 | Miyagawa et al. |
| 5,948,290 | A | 9/1999 | Yamamoto et al. |
| 5,988,786 | A | 11/1999 | Waller et al. |
| 6,135,586 | A | 10/2000 | McClelland et al. |
| 6,155,673 | A | 12/2000 | Nakajima et al. |
| 6,155,677 | A | 12/2000 | Kitani et al. |
| 6,220,697 | B1 | 4/2001 | Yamanaka et al. |

FOREIGN PATENT DOCUMENTS

| | | |
|---|---|---|
| EP | 0 528 440 B1 | 2/1993 |
| EP | 0 600 382 A | 6/1994 |
| EP | 0 719 642 A | 7/1996 |

*Primary Examiner*—Raquel Yvette Gordon
(74) *Attorney, Agent, or Firm*—Fitzpatrick, Cella, Harper & Scinto

(57) ABSTRACT

The present invention provides a liquid discharge recording head comprising a substrate on which an energy generating element for generating liquid discharging energy is provided, and an orifice plate which is laminated with the substrate and in which a discharge port corresponding to the energy generating element is provided, and wherein a liquid droplet is discharged in a direction substantially perpendicular to surfaces of the substrate and the orifice plate, and further wherein a flow path is formed between the substrate and the orifice plate, a groove encircling the flow path is formed in the orifice plate, and edge portions of the orifice plate contacted with the groove are formed as saw-shaped portions having a number of minute indentations.

23 Claims, 20 Drawing Sheets

LIQUID DISCHARGE RECORDING HEAD AND METHOD FOR MANUFACTURING THE SAME

BACKGROUND OF THE INVENTION

1. Field of the Invention

The present invention relates to a liquid discharge recording head (ink jet recording head) used in liquid discharge recording (ink jet recording) for discharging liquid such as ink toward a recording medium, and a method for manufacturing such a liquid discharge recording head.

2. Related Background Art

As one aspect of recording apparatus for forming an image (here, regardless of meanings, a character, a figure, a pattern and/or the like are referred to as "image") on a recording medium such as a recording paper, there is a liquid discharge recording apparatus (ink jet recording apparatus) for discharging minute ink droplet(s) from minute discharge port(s).

Among the liquid discharge recording heads, there are a liquid discharge recording head of edge shooter type in which an ink droplet is discharged in parallel with a substrate on which energy generating elements are formed and a liquid discharge recording head of side shooter type in which an ink droplet is discharged in perpendicular to the substrate. For example, Japanese Patent Application Laid-open Nos. 4-10940 (1992), 4-10941 (1992) and 4-10942 (1992) disclose a liquid discharge recording head of side shooter type. In the liquid discharge recording heads disclosed in these documents, an ink droplet is discharged while communicating a bubble generated by heating the heat generating resistance body with the atmosphere. In such a liquid discharge recording head, reduction of a distance between the energy generating element and the orifice and small liquid droplet recording which were difficult to achieve in the liquid discharge recording head of side shooter type in the conventional manufacturing method (for example, disclosed in Japanese Patent Application Laid-open No. 62-234941 (1987) can easily be achieved, and, thus, recent request for highly fine recording can be satisfied.

Further, in recent years, a higher output speed of a printer has been requested. The reason is that high density ink droplets is requested as a processing speed of a computer has been enhanced and an ink droplet has been minimized in order to output a highly fine image. Further, in printers for handling a large size recording medium and printers connected to a network, the request for high speed becomes more noticeable. The high output speed of the printer can be achieved by increasing the number of ink droplets per unit time, i.e., ink discharging frequency and/or by increasing the number of ink discharge ports. Normally, the high output speed of the printer is achieved by increasing the both. However, when the number of ink discharge ports is increased, nozzle arrays are increased, which leads to increase the dimension of the liquid discharge recording head.

In such a liquid discharge recording head, as shown in FIG. 22A, an orifice plate 105 having a plurality of ink discharge ports 106 is joined to a substrate 102. As shown in FIG. 22B, an ink supply port 107 is formed in the substrate 102, and a plurality of energy generating elements (heat generating resistance bodies) 101 are disposed on a surface of the substrate 102 joined to the orifice plate 105 at positions corresponding to the ink discharge ports 106. As shown in FIG. 22C, an ink flow path (liquid chamber) 108 extending from the ink supply port 107 and communicated with the ink discharge ports 106 above the heat generating resistance bodies 101 is formed between the substrate 102 and the orifice plate 105. Accordingly, ink is supplied from the ink supply port 107 to the ink flow path 108 and is discharged from the ink discharge port 106 by pressure of a bubble generated by the action of the heat generating resistance body 101. Incidentally, in the drawings, for simplicity's sake, the ink discharge ports and the heat generating resistance bodies are schematically shown only in part or plural fine discharge port arrays are shown in a straight manner.

In a method for manufacturing such a liquid discharge recording head, as shown in FIGS. 23A to 23D, a soluble resin layer 103 is formed on the substrate 102 on which the ink discharging energy generating elements (heat generating resistance bodies) 101 were formed, and, then, a coat resin layer 105 which constitutes the orifice plate later is coated by spin coating or the like. Thereafter, the soluble resin layer 103 is dissolved and the ink supply port 107 is formed in the substrate 102. As a result, the dissolved portion of the resin layer 103 becomes the ink flow path 108 communicated with the ink discharge ports 106 and the ink supply port 107, and the heat generating resistance bodies 101 are disposed in a confronting relationship to the ink flow path 108. However, in this method, as shown in FIG. 22C and by the two dot and chain line in FIG. 23, it is difficult to form the coat resin layer in a flat shape. As shown in FIGS. 23B to 23D, the coat resin layer 105 is formed along corner portions (stepped portions) of the soluble resin layer 103, with the result that a thick portion and a thin portion is included in the orifice plate 105 (dispersion). When a liquid discharge recording head in which the thickness of the orifice plate 105 is uneven is used, the thin portion of the orifice plate 105 is subjected to concentrated stress, with the result that the orifice plate may be apt to be peeled from the substrate 102, reliability may be worsened and a service life of the liquid discharge recording head may be shortened. Further, since the ink discharged amount is determined by a distance (gap) between the heat generating resistance body 101 for generating the ink discharge energy and the front surface of the orifice plate 101, as shown in FIGS. 23B to 23D, when the thickness of the orifice plate 105 is not uniform and the gaps between the orifice plate and the heat generating resistance bodies 101 are uneven, it is very difficult to stably effect the small liquid droplet recording which is an effective method for realizing the highly fine recording.

A method for solving such a problem is disclosed in Japanese Patent Application Laid-open Nos. 10-157150 (1998) and 11-138817 (1999). In the manufacturing method disclosed in such documents, for the purpose of the flattening of the orifice plate 105, the soluble resin layer 103 is formed not only as the pattern of the ink flow path 108 but also around outer periphery thereof, and the coat resin layer 105 is formed by using the soluble resin layer 103 as foundation. This manufacturing method will be fully explained with reference to FIGS. 24A to 24D. Incidentally, in the actual manufacturing, although a plurality of heads are usually manufactured simultaneously on a single substrate, for simplifying the explanation, here, the manufacture of the single head will be explained.

First of all, as shown in FIG. 24A, a soluble resin layer 103 is formed on a substrate 102 on which a predetermined number of heat generating resistance bodies (electrical/thermal converting elements) 101 as ink discharging energy generating elements were arranged at predetermined positions. In this case, the soluble resin layer 103 includes not only a pattern 103*a* constituting an ink flow path but also a pattern 103*b* constituting a foundation encircling outer periphery of the ink flow path. Incidentally, the soluble resin layer 103 is coated, for example, by laminating of dry film or spin coating of resist and then is patterned, for example, by exposure and development by using ultraviolet ray (deep-UV light).

More concretely, after polymethyl isopropenyl ketone (such as ODUR-1010 manufactured by TOKYO OUKA KOGYO Co., Ltd.) is coated by spin coating and then is dried, it is patterned exposure and development by using deep-UV light.

Then, as shown in FIG. 24B, a coat resin layer 105 is formed on the soluble resin layer 103 by spin coating or the like.

In this case, if there is no pattern 103*b* as the foundation, since the portion encircling the outer peripheral portion of the pattern 103*a* constituting the ink flow path becomes a lower surface which exposes the substrate 102 completely through a large area, as shown in FIGS. 23B to 23D, the coat resin layer 105 forms a mountain shape with an apex corresponding to the pattern 103*a* gradually sloping down, thereby making the thickness of the coat resin layer uneven. However, as shown in FIG. 24B, when the pattern 103*b* constituting the foundation is provided, also in the portion encircling the outer peripheral portion of the pattern 103*a* constituting the ink flow path, since a lower surface which exposes the substrate 102 is not so a large area, the coat resin layer 105 is formed with a uniform height. Of course, the coat resin layer 105 is formed very flatly above the pattern 103*a* constituting the ink flow path.

Then, as shown in FIG. 24C, ink discharge ports 106 are formed in the coat resin layer 105, and an opening portion 104 is formed above and around the pattern 103*b* constituting the foundation. Formation of the ink discharge ports 106 and the opening portion 104 can be effected by exposure and development using ultraviolet ray (deep-UV light), for example. More concretely, after negative resist is coated by spin coating and is dried, by pattern-exposing and developing it, the ink discharge ports 106 and the opening portion 104 can be formed.

Then, the substrate 102 is subjected to chemical etching to form an ink supply port 107. For example, when an Si substrate is used as the substrate, the ink supply port 107 is formed by anisotropic etching using strong alkali solution such as KOH, NaOH or TMAH. As more concrete example, the ink supply port 107 is formed by patterning a thermal oxidation film formed on an Si substrate in which crystal orientation is <110> and then by etching the Si substrate by using solution including TMAH of 22% a temperature of which is adjusted to 80° C. for ten and several hours.

Then, as shown in FIG. 24D, the soluble resin layer 103 is dissolved to form the ink flow path 108 and a groove 109 encircling the ink flow path. The removal of the soluble resin layer 103 can be performed by effecting whole surface exposure using deep-UV light and then by effecting dissolution and drying, and, when ultrasonic treatment is effected upon dissolution, the resin layer 103 can be removed positively for a shorter time.

Although not shown, a plurality of liquid discharging mechanisms shown in FIG. 24D are formed on the single substrate 102 by the aforementioned steps, and, after such mechanisms are completed, the substrate 102 is divided and cut by a dicing saw to form chips, and, after electrical connection for driving the heat generating resistance bodies is completed, a member such as an ink tank for supplying the ink is joined to the chip, thereby completing the liquid discharge recording head.

Incidentally, the formation of the ink supply port 107 may be performed before the formation of the soluble resin layer 103 and/or before the formation of the ink discharge ports 106 and the opening portion 104.

In this way, according to the method in which the groove 109 is formed around the ink flow path 108, since the coat resin layer 105 can be formed flatly and the thickness of the orifice plate 105 becomes uniform, in the liquid discharge recording head, the distance between the front surface of the orifice plate 105 and the heat generating resistance bodies 101 becomes uniform, with the result that the small liquid droplet recording for realizing highly fine recording can be performed stably.

Further, since the orifice plate 105 does not cover all of portions other than the ink discharge ports 106 and the electrical connections, it can be prevent that the substrate 102 is deformed due to stress generated by the hardening and/or temperature change of the orifice plate 105 and that the stress concentrates on edges of the orifice plate 105, i.e., wall portions of the ink flow path 108 thereby to cause peeling between the orifice plate and the substrate 102.

Further, since the orifice plate 105 covers not only the vicinity of the ink discharge ports 106 but also outside portions thereof, a large area of the surface of the substrate 102 is not exposed, with the result that the surface of the substrate 102 is not damaged when the liquid discharge recording head is actually mounted or when the head is mounted to the printer to be used.

In this way, stress acting on the wall portions of the ink flow path 108 is reduced as small as possible, and the surface of the substrate 102 is prevented from being damaged.

FIGS. 25A to 25C schematically show the liquid discharge recording head looked at from the above. In the liquid discharge recording head, a single array of the ink discharge ports 106 is disposed at each side of the ink supply port 107.

From various tests, it was found that edge portions of the groove 109 formed around the ink flow path 108 of the ink discharge recording head manufactured in this way, i.e., edges of the orifice plate 105 may be peeled as the length of the liquid discharge recording head is increased. Particularly, in comparison with an inner side where the volume of the orifice plate 105 is reduced because of the provision of the ink discharge ports 106 and the ink flow path 108, an outer portion of the orifice plate 105 has greater volume, with the result that, since the stress acting on the outer portion of the orifice plate 105 becomes greater, the possibility of generating the peeling is increased. Further, it was also found that the greater the thickness of the orifice plate 105 of the liquid discharge recording head (to increase the stress), the greater the possibility of such peeling.

FIGS. 25A to 25C are schematic views for explaining a relationship between the stress and the peeling. Particularly, in FIGS. 25B and 25C, the arrows show directions of the stress 110 acting on the edge portions of the orifice plate 105 and changed due to expansion/contraction caused by contraction and/or heat change during the curing. The stress 110 directs toward a central portion of resin when the resin is contracted and directs outwardly (directions opposite to the arrows) when the resin is expanded. Particularly, it is considered that the stress (shown by the arrows in FIGS. 25B and 25C) which directs toward the central portion of the resin generates the peeling of the orifice plate 105.

The stress 110 acts in directions perpendicular to the groove 109 (perpendicular to a tangential line of the groove when the groove 109 is curved) at edges contacted with the groove 109 of the orifice plate 105. Thus, at the edge portions of the orifice plate 105 contacted with the groove 109, forces which try to peel the edges are generated, and, since such forces direct toward the edge portions, the stress 110 acts against the edge portions as it is, with the result that the peeling apt to be occurred.

FIG. 25C is an enlarged view of a portion encircled by a circle in FIG. 25B, for explaining stress components 110 acting on both sides of the groove 109 in detail. In FIG. 25C, there is the groove 109 at the center, and the stress components 110 act on edge portions of the groove in the orifice plate 105. As mentioned above, since the stress components 110 acts in the directions perpendicular to the edge portions of the orifice plate 105, the entire stress components 110 constitute the forces which try to peel the orifice plate 105 as they are. Since the greater the area and thickness of the orifice plate 105 the greater the stress components 110, in case of an orifice plate 105 having a greater length, the peeling is more apt to occur.

As mentioned above, in recent years, the high speed recording has been requested, and, to this end, a liquid discharge recording head having a greater length rather than a liquid discharge recording head having the greater number of ink discharge ports has been requested. However, the greater the length of the liquid discharge recording head, the greater the internal stress in the coat resin layer (orifice plate) 105 in which the ink discharge ports 106 are formed. Consequently, when print endurance tests with factor of safety regarding the practical number of prints are effected, there arise an inconvenience that the orifice plate 105 is peeled from the substrate 102 around the edges contacted with the groove 109. According to circumstances, such peeling may reach the area where the ink discharge ports 106 are formed, with the result that the discharging performance is worsened and poor recording occurs if worst comes to worst. FIGS. 26A and 26B schematically show occurrence of such peeling. As shown in FIGS. 26A and 26B, it can be seen that the peeling (peeled portions 111) occurs between the substrate 102 and the orifice plate 105 around the edge portions contacted with the groove 109.

SUMMARY OF THE INVENTION

The present invention is made in consideration of the above-mentioned conventional drawbacks, and an object of the present invention is to provide a liquid discharge recording head of side shooter type in which peeling does not occur if the head becomes longer and which has good reliability, and a method for manufacturing such a head.

The present invention provides a liquid discharge recording head comprising a substrate on which an energy generating element for generating liquid discharging energy is provided, and an orifice plate which is laminated with the substrate and in which a discharge port corresponding to the energy generating element is provided, and wherein a liquid droplet is discharged in a direction substantially perpendicular to surfaces of the substrate and the orifice plate, and further wherein a flow path is formed between the substrate and the orifice plate, and a groove encircling the flow path is formed in the orifice plate, and edge portions of the orifice plate contacted with the groove are formed as saw-shaped portions having a number of minute indentations.

The edge portion of the orifice plate contacted with the groove does not have continuously a portion perpendicular to a direction of stress acting on the edge portion.

The indentations provided on the edge portion of the orifice plate contacted with the groove may be constituted by a combination of straight segments, and each straight segment may not have the portion perpendicular to the direction of the stress acting on the edge portion. Alternatively, the indentations provided on the edge portion of the orifice plate contacted with the groove may be constituted by a combination of curved segments, and a tangential line to each curved segment may not have continuously the portion perpendicular to the direction of the stress acting on the edge portion. Alternatively, the indentations provided on the edge portion of the orifice plate contacted with the groove may be constituted by a combination of straight segments and curved segments, and each straight segment may not have the portion perpendicular to the direction of the stress acting on the edge portion and a tangential line to each curved segment may not have continuously the portion perpendicular to the direction of the stress acting on the edge portion.

A portion of the orifice plate disposed outside of the groove may be divided into plural regions.

At least a part of edge portions of the orifice plate contacted with the flow path may be formed as saw-shaped portions having a number of minute indentations. At least the part of the edge portions of the orifice plate contacted with the flow path does not have continuously a portion perpendicular to the direction of stress acting on the edge portion.

A plurality of through-holes reaching the substrate in a thickness direction may be formed in a portion of the orifice plate except for the flow path.

A plurality of recessed portions not reaching the substrate in the thickness direction may be formed in a portion of the orifice plate except for the flow path. The recessed portions may be recessed grooves.

The portion of the orifice plate disposed outside of the groove may have a thickness smaller than those of other portions.

The orifice plate may have a ceiling portion covering a space above the groove.

Further, the present invention provides a liquid discharge recording head comprising a substrate on which an energy generating element for generating liquid discharging energy is provided and an orifice plate which is laminated with the substrate and in which a discharge port corresponding to the energy generating element is provided, and wherein a liquid droplet is discharged in a direction substantially perpendicular to surfaces of the substrate and the orifice plate, and further wherein a flow path is formed between the substrate and the orifice plate, and the orifice plate has a hole array including a plurality of holes and encircling the flow path.

The present invention further provides a method for manufacturing a liquid discharge recording head comprising a substrate on which an energy generating element for generating liquid discharging energy is provided and an orifice plate which is laminated with the substrate and in which a discharge port corresponding to the energy generating element is provided, and wherein a liquid droplet is discharged in a direction substantially perpendicular to surfaces of the substrate and the orifice plate, the method comprising a step for forming a soluble resin layer including a pattern constituting the flow path and a pattern constituting a foundation having a configuration encircling the pattern constituting the flow path on a surface of the substrate on which the energy generating element is provided, a step for forming a coat resin layer constituting the orifice plate on the substrate and the soluble resin layer, and a step for forming, by dissolving the soluble resin layer, the flow path in an area where the pattern constituting the flow path was existed and a groove in an area where the pattern constituting the foundation was existed, and being characterized in that edge portions of the pattern constituting the foundation are formed as saw-shaped portions having a number of minute indentations.

A portion of the orifice plate comprised of the coat resin layer disposed outside of the area where the flow path to be formed may be divided into plural regions.

At least a part of the edge portions of the pattern constituting the flow path may be formed as a saw-shaped portion having a number of minute indentations.

A portion of the orifice plate comprised of the coat resin layer except for the area where the flow path is to be formed may be provided with a plurality of through-holes passing through a thickness direction.

A portion of the orifice plate comprised of the coat resin layer except for the area where the flow path is to be formed may be provided with a plurality of recessed portions not passing through a thickness direction.

The method may further comprises a step for reducing a thickness of a portion of the orifice plate comprised of the coat resin layer disposed outside of the area where the flow path is to be formed by half etching.

A ceiling portion for the groove may be formed by remaining at least a part of a portion covering a space above the area where the pattern constituting the foundation is to be formed on the coat resin layer constituting the orifice plate.

The present invention further provides a method for manufacturing a liquid discharge recording head comprising a substrate on which an energy generating element for generating liquid discharging energy is provided and an orifice plate which is laminated with the substrate and in which a discharge port corresponding to the energy generating element is provided, and wherein a liquid droplet is discharged in a direction substantially perpendicular to surfaces of the substrate and the orifice plate, the method comprising a step for forming a soluble resin layer including a pattern constituting the flow path and a pattern constituting a foundation having a cylinder array configuration encircling the pattern constituting the flow path on a surface of the substrate on which the energy generating element is provided, a step for forming a coat resin layer constituting the orifice plate on the substrate and the soluble resin layer, and a step for forming, by dissolving the soluble resin layer, the flow path in an area where the pattern constituting the flow path was existed and a hole array in an area where the pattern constituting the foundation was existed.

In the above-mentioned liquid discharge recording head, even when the head is used for a long term, the edge portions of the orifice plate are not peeled from the substrate at all or, even if such peeling occurs, the level of the peeling does not arise any practical problem, with the result that, since good and stable liquid discharge recording can be maintained, endurance and reliability can be enhanced.

DETAILED DESCRIPTION OF THE PREFERRED EMBODIMENTS

The present invention will now be explained in connection with embodiments thereof with reference to the accompanying drawings.

[First Embodiment]

A liquid discharge recording head according to a first embodiment of the present invention is shown in FIGS. 1A to 1C and FIGS. 2A and 2B. In the liquid discharge recording head according to the first embodiment, a contour of a groove 9, i.e., edge portions of an orifice plate 5 contacted with the groove 9 are formed as saw-shaped portions having fine indentations, rather than a straight line. The other constructions are substantially the same as that of the conventional liquid discharge recording head shown in FIGS. 24A to 24D and FIGS. 25A to 25C.

Figure 1A:
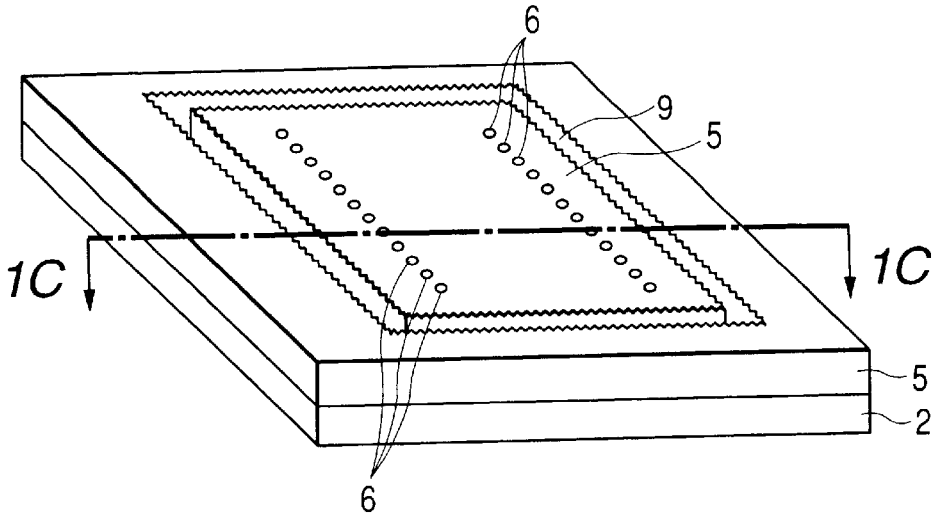
FIG. 1A is a perspective view showing a liquid discharge recording head according to a first embodiment of the present invention.
Figure 1B:
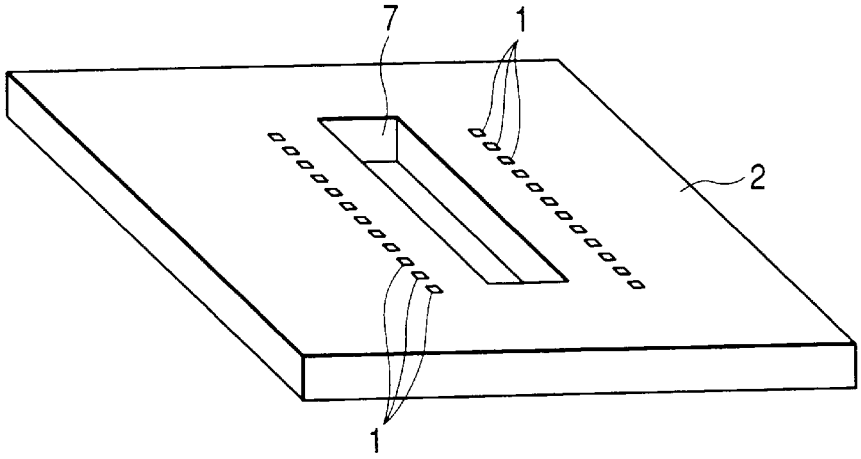
FIG. 1B is a perspective view of a substrate according to the first embodiment.
Figure 1C:
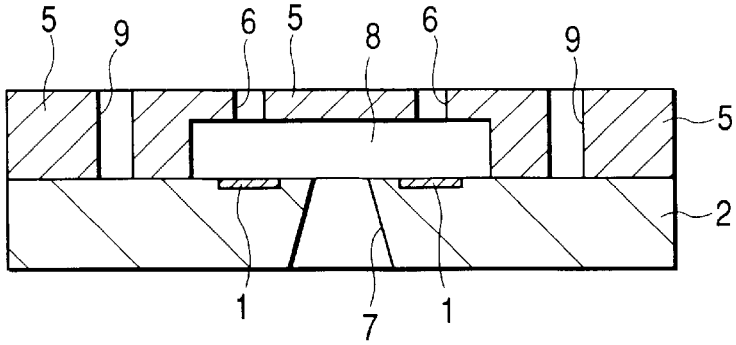
FIG. 1C is a sectional view of the liquid discharge recording head, taken along a line 1C—1C in FIG. 1A, according to the first embodiment.

A construction of the liquid discharge recording head will be briefly explained. As shown in FIGS. 1A to 1C, the liquid discharge recording head is constituted by joining the orifice plate 5 having a plurality of ink discharge ports 6 to a substrate 2. An ink supply port 7 is opened or formed in the substrate 2, and a plurality of energy generating elements (heat generating resistance bodies) 1 are disposed on a surface of the substrate joined to the orifice plate 5 at positions corresponding to the ink discharge ports 6. An ink flow path (liquid chamber) 8 extending from the ink supply port 7 to the ink discharge ports 6 above the heat generating resistance bodies 1 and a groove 9 provided to encircle the ink flow path 8 are formed between the substrate 2 and the orifice plate 5. Incidentally, although the orifice plate 5 is completely divided into an inner portion for closing the ink flow path 8 and an outer portion by the presence of the groove 9, the entire assembly including these inner and outer portions in referred to as "orifice plate (or coat resin layer) 5". In the liquid discharge recording head, when ink is supplied from the ink supply path 7 to the ink flow path 8 and the heat generating resistance body 1 is driven, the ink in the ink flow path 8 is heated to generate a bubble by which the ink is discharged outwardly from the ink discharge port 6.

Figure 2A:
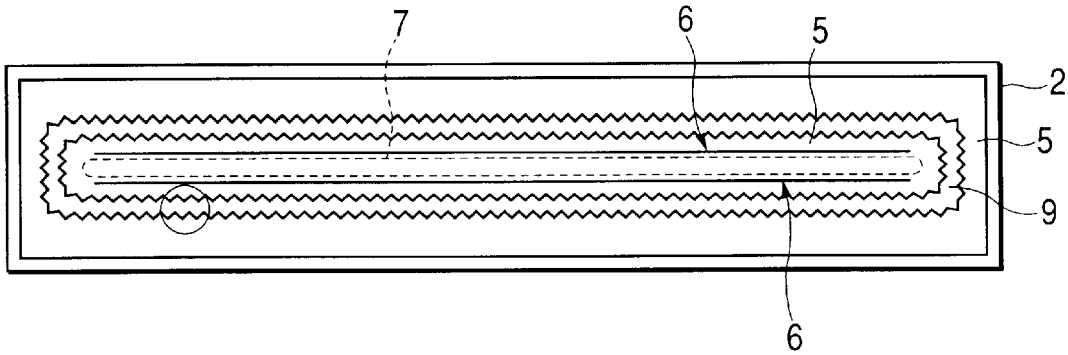
FIG. 2A is a plan view showing the liquid discharge recording head according to the first embodiment.
Figure 2B:
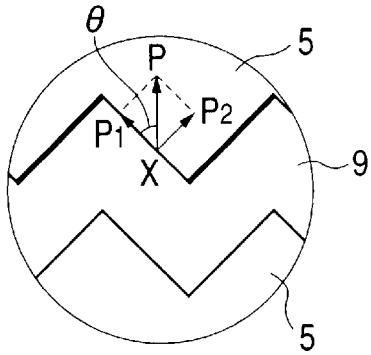
FIG. 2B is an enlarged view of a part thereof.

As shown in FIGS. 2A and 2B, edge portions of the orifice plate 5 comprised of the coat resin layer contacted with the groove 9 are formed as saw-shaped portions, and a straight segment is inclined by an angle θ with respect to stress P. Here, $\theta \neq 90°$. That is to say, since each straight segment of the edge portion of the orifice plate 5 is inclined by the angle θ (not right angle) with respect to a direction along which the stress P acts, for example, the stress P acting on a point X is divided into a stress component $P_1$ directing along the edge portion and a stress component $P_2$ perpendicular to the edge portion. Among them, the force $P_2$ acting on the point X and trying to peel the orifice plate 5 can be represented by the following equation:

$$P_2 = P \sin \theta$$

Here, since $\theta \neq 90°$, sin θ becomes smaller than 1 (<1). Accordingly, $P_2 < P$, and, thus, in comparison with the conventional cases, the force trying to peel the orifice plate becomes very small. Thus, it is hard to occur the peeling or the peeling is hard to be grown.

Figure 25A:
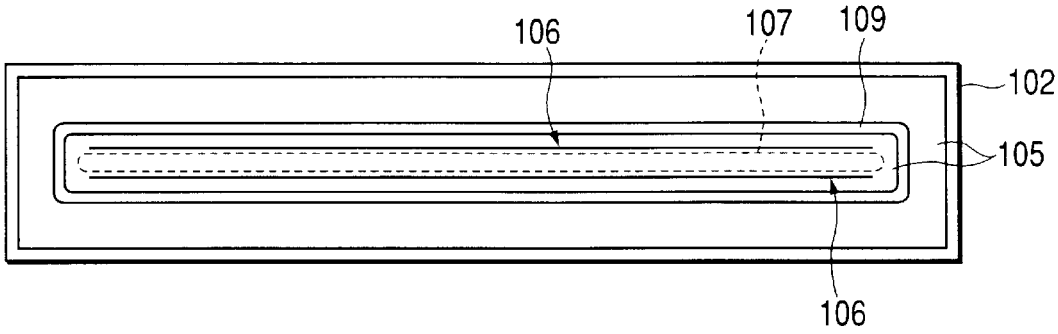
FIG. 25A PRIOR ART
FIGS. 25A and 25B are plan views showing the second conventional liquid discharge recording head.
Figure 25B:
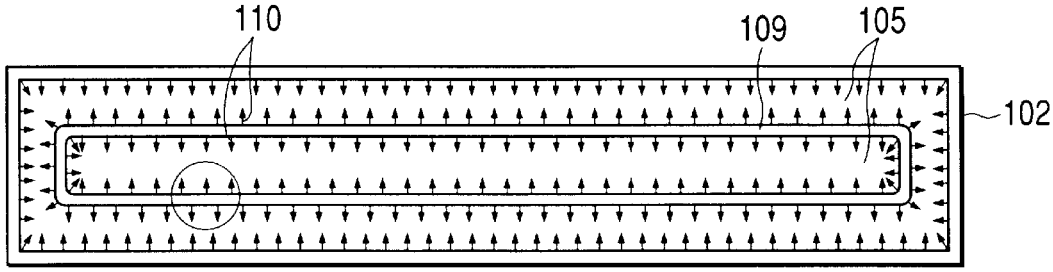
FIG. 25B PRIOR ART
Figure 25C:
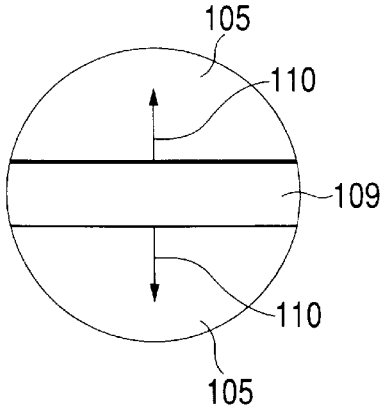
FIG. 25C PRIOR ART
FIG. 25C is an enlarged view of a part thereof.
Figure 26A:
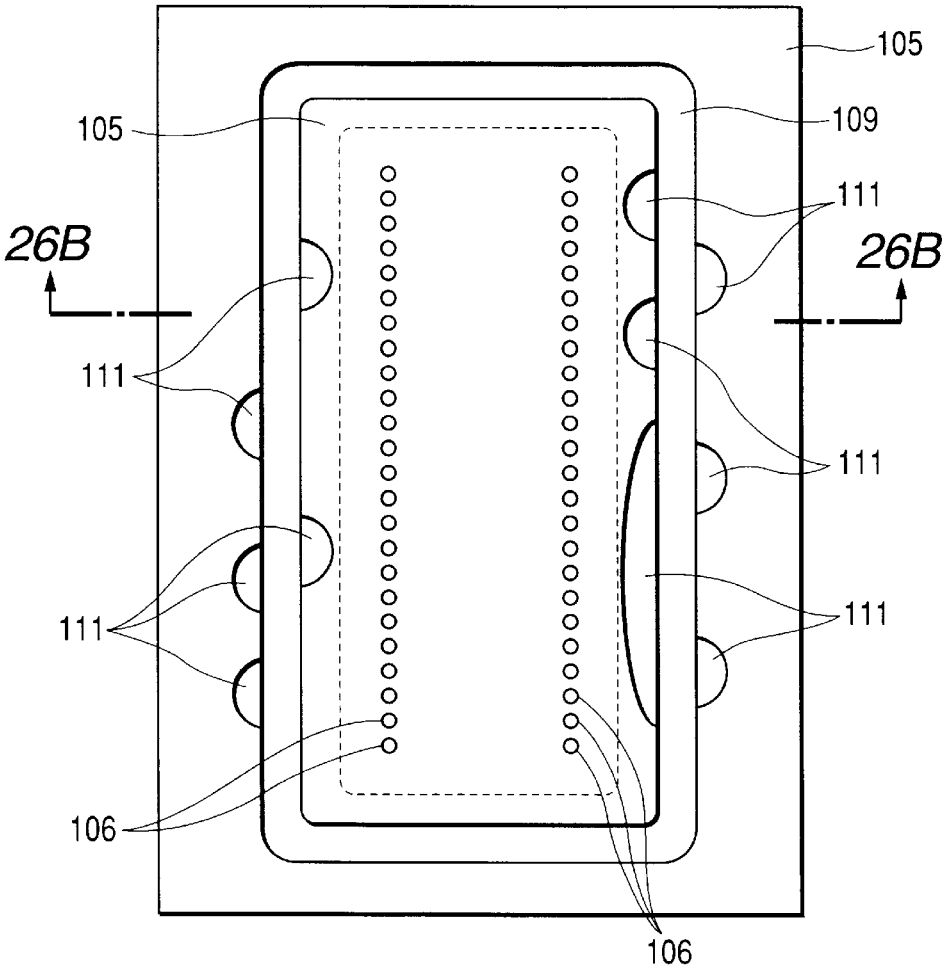
FIG. 26A PRIOR ART
FIG. 26A is a plan view showing a defect of the second conventional liquid discharge recording head.
Figure 26B:
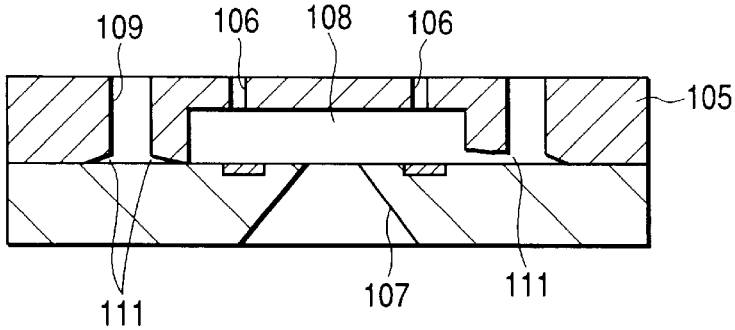
FIG. 26B PRIOR ART
FIG. 26B is a sectional view taken along a line 26B—26B in FIG. 26A.

As is in the conventional case shown in FIGS. 25A to 25C, if the edge portions of the orifice plate 105 contacted with the groove 109 are straight, since all of the stress components act in the same direction across the large area, the great total stress acts on the orifice plate 105 through such a large area. However, in the illustrate embodiment, since the edge portions of the orifice plate 5 contacted with the groove 9 are formed as the saw-shaped portions, there are stress components directing toward various directions within the same range, with the result that parts of the stress components are cancelled with each other to reduce the total stress acting on the orifice plate 5 within this range in comparison with the conventional case. Accordingly, easiness of peeling can be suppressed.

Next, a method for manufacturing the liquid discharge recording head according to the illustrate embodiment will be explained with reference to FIGS. 3A to 3D. Here, as an example, a method for manufacturing a liquid discharge recording head which has a wide print width and is capable of performing high speed printing and in which a width of a nozzle array is 1 inch will be explained.

Figure 3A:
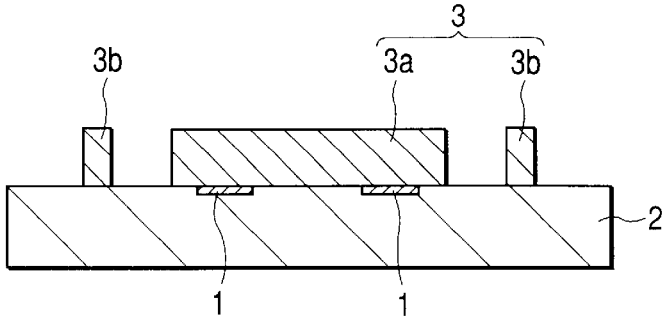
FIGS. 3A, 3B, 3C and 3D are sectional views showing a method for manufacturing the liquid discharge recording head according to the first embodiment.

First of all, as shown in FIG. 3A, a predetermined number of ink discharging energy generating elements such as the heat generating resistance bodies (electrical/thermal converting elements) 1 are installed on the substrate 2 at predetermined positions. Here, 640 heat generating resistance bodies 1 are installed with density of 600 per one inch.

Then, the soluble resin layer 3 is formed on the substrate 2 including the heat generating resistance bodies 1. The soluble resin layer 3 includes a pattern 3*a* constituting the ink flow path and a pattern 3*b* constituting a foundation. The soluble resin layer 3 is coated, for example, by laminating of dry film or spin coating of resist and then is patterned, for example, by exposure and development by using ultraviolet ray (deep-UV light). More concretely, after polymethyl isopropenyl ketone (such as ODUR-1010 manufactured by TOKYO OUKA KOGYO Co., Ltd.) is coated by spin coating and then is dried, it is patterned exposure and development by using deep-UV light. Incidentally, an outer edge portion (portion contacted with an inner side wall of the groove 9 which will be described later) of the pattern 3*a* constituting the ink flow path and an inner edge portion (portion contacted with an outer side wall of the groove 9 which will be described later) of the pattern 3*b* constituting the foundation are formed as saw-shaped portions having minute indentations.

Figure 3B:
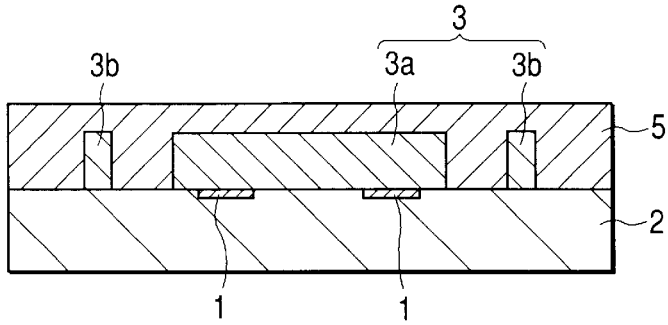
Figure 3C:
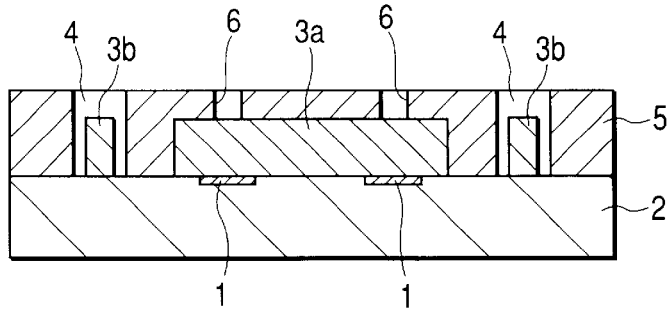

Then, as shown in FIG. 3B, the coat resin layer 5 constituting the orifice plate is formed on the soluble resin layer 3 by spin coating or the like. In this case, since the pattern 3*b* of the soluble resin layer 3 constituting the foundation is formed, the coat resin layer 5 can be formed in a flat form above the pattern 3*a* constituting the ink flow path. And, as shown in FIG. 3*c*, the ink discharge ports 6 are formed in the coat resin layer 5. Further, simultaneously with or different from the formation of the ink discharge ports, an opening portion 4 for removing the pattern 3*b* constituting the foundation is formed in the same manner as the formation of the ink discharge ports 6. The formation of the ink discharge ports 6 and the opening portion 4 can be effected by exposure and development using ultraviolet ray (deep-UV light), for example. More concretely, after negative resist is coated by spin coating and is dried, by pattern-exposing and developing it, the ink discharge ports 6 and the opening portion 4 can be formed.

Then, the substrate 2 is subjected to chemical etching to form the ink supply port 7. For example, when an Si substrate is used as the substrate, the ink supply port 7 is formed by anisotropic etching using strong alkali solution such as KOH, NaOH or TMAH. As more concrete example, the ink supply port 7 is formed by patterning a thermal oxidation film formed on an Si substrate in which crystal orientation is <110> and then by etching the Si substrate by using solution including TMAH of 22% a temperature of which is adjusted to 80° C. for ten and several hours.

Figure 3D:
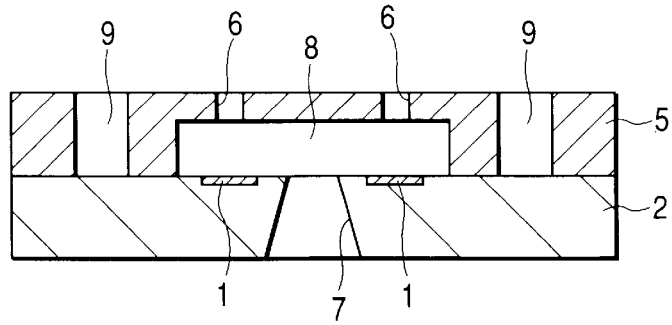

Then, as shown in FIG. 3D, the soluble resin layer 3 is dissolved to form the ink flow path 8 and the groove 9 encircling the ink flow path. The removal of the soluble resin layer 3 can be performed by effecting whole surface exposure using deep-UV light and then by effecting dissolution and drying, and, when ultrasonic treatment is effected upon dissolution, the resin layer 3 can be removed more positively for a shorter time.

Although not shown, a plurality of liquid discharging mechanisms shown in FIG. 3D are formed on the single substrate 2 at plural positions by the aforementioned steps, and, after such mechanisms are completed, the substrate 2 is divided and cut by a dicing saw to form chips, and, after electrical connection for driving the heat generating resistance bodies 1 is completed, a member such as an ink tank for supplying the ink is joined to the chip, thereby completing the liquid discharge recording head.

Incidentally, the formation of the ink supply port 7 may be performed before the formation of the soluble resin layer 3 and/or before the formation of the ink discharge ports 6 and the opening portion 4.

Similar to the conventional cases, the liquid discharge recording head manufactured in this way, the small liquid droplet recording for realizing highly fine recording can be performed stably, and the stress acting on the wall portions of the ink flow path 8 can be reduced as small as possible, and the surface of the substrate 2 can be prevented from being damaged, and, as mentioned above, the peeling of the orifice plate 5 form the substrate 2 can be suppressed.

By using the liquid discharge recording head manufactured as mentioned above, a temperature/humidity cycle test was performed in a condition that the chip portion including the substrate 2 is capped by rubber. More concretely, the temperature/humidity cycle test was performed in the following manner. First of all, a temperature is constantly increased from 25° C. to 65° C. for 2 hours and 30 minutes while maintaining relative humidity to 95%, and, after the temperature is maintained to 65° C. for 3 hours, the temperature is constantly decreased to 25° C. for 2 hours and 30 minutes, and, thereafter, the temperature is constantly increased from 25° C. to 65° C. for 2 hours and 30 minutes again, and, after the temperature is maintained to 65° C. for 3 hours, the temperature is constantly decreased to 25° C. for 2 hour and 30 minutes again, and, then, after the temperature is maintained to 25° C. for 1 hour and 30 minutes, the relative humidity is made to 0% and the temperature is made to −10° C. and then this condition is maintained for 3 hours and 30 minutes, and, then, the relative humidity is made to 95% and the temperature is made to 25° C. and then this condition is maintained for 3 hours. These steps are regarded as one cycle, and 10 cycles were performed.

As a result, in the liquid discharge recording head according to the illustrated embodiment, it was found that the peeling of the edge portions of the orifice plate 5 contacted with the groove 9 does not occur at all or, if occurs, a level of such peeling does not arise any problem substantially. When the recording was effected before and after the temperature/humidity cycle test, there was no change and good recording was achieved. Incidentally, for the comparison purpose, the similar temperature/humidity cycle test was performed by using the liquid discharge recording head shown in FIGS. 25A to 25C. As a result, in the conventional liquid discharge recording head, the peeling of the orifice plate 105 was generated at the edge portions of the orifice plate 105 contacted with the groove 109, and, in some cases, the peeling reached the ink flow path 108, which permitted only low quality recording with thin color.

[Second Embodiment]

Figure 4:
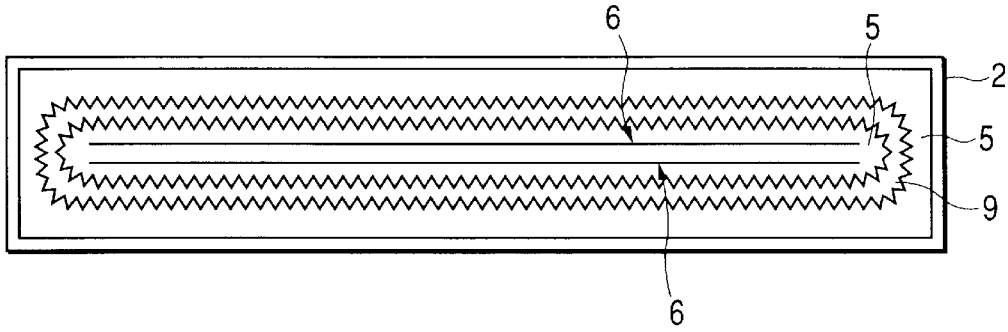
FIG. 4 is a plan view showing a liquid discharge recording head according to a second embodiment of the present invention.

FIG. 4 shows a liquid discharge recording head according to a second embodiment of the present invention. Incidentally, the same elements as those in the first embodiment are designated by the same reference numerals and explanation thereof will be omitted.

In FIG. 4, elements other than the substrate 2, orifice plate (coat resin layer) 5 and groove 9 are omitted from illustration. As shown in FIG. 4, the edge portions of the orifices plate 5 contacted with the groove 9 are formed as saw-shaped portions having a more acute angle so that the angle θ between the straight segment of each edge portion of the orifice plate 5 and the stress P becomes smaller than that in the first embodiment. Thus, the stress component $P_2$ of the stress P, i.e., the force trying to peel the orifice plate 5 from the substrate 2 becomes smaller.

As a result of the above-mentioned temperature/humidity cycle test using the liquid discharge recording head according to this embodiment, it was found that, similar to the first embodiment, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved.

[Third Embodiment]

Figure 5A:
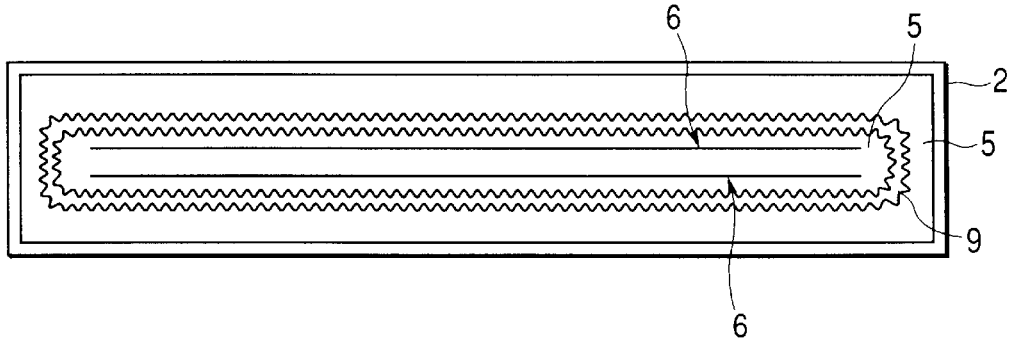
FIG. 5A is a plan view showing a liquid discharge recording head according to a third embodiment of the present invention.
Figure 5B:
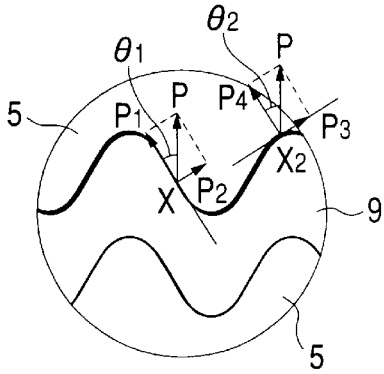
FIG. 5B is an enlarged view of a part thereof.

FIGS. 5A and 5B show a liquid discharge recording head according to a third embodiment of the present invention. Incidentally, the same elements as those in the first and second embodiments are designated by the same reference numerals and explanation thereof will be omitted.

As shown in FIGS. 5A and 5B, the edge portions of the orifice plate 5 contacted with the groove 9 are formed as rounded saw-shaped portions. That is to say, each top or peak of saw tooth is rounded or curved. In the straight segment of the edge portions of the orifice plate 5, similar to the first embodiment, the force component $P_2$ trying to generating the peeling is smaller than the stress P ($P_2$=P sin $\theta_1$<90°). Further, in the vicinity of the peak of the saw tooth of the orifice plate 5, the angle is continuously changed, so that the stress component (trying to generate the peeling) of the stress P acting on the edge portion is also smaller than the stress P. More concretely, as shown in FIG. 5B, at a point $X_2$ located in the vicinity of the rounded peak of the saw tooth, a tangential line of the edge portion of the orifice plate 5 is inclined by an angle $(90°-\theta_2)$ with respect to the stress. The stress P at the point $X_2$ can be divided into a tangential stress component $P_3$ and a normal stress component $P_4$. A force trying to generate the peeling at the point $X_2$ is the stress component $P_4$ which is a force perpendicular to the orifice plate 5. Since $P_4=(90°-\theta_2)$ and $(90°-\theta_2)<90°$, the force trying to generate the peeling is smaller than the stress P itself. However, only at the peak of the saw tooth of the orifice plate 5, since the tangential line becomes perpendicular to the stress, the stress P becomes the force trying to generate the peeling as it is. However, since the angle between the tangential line and the stress is continuously changed and the tangential line becomes perpendicular to the stress only at one point (peak), regarding almost all of points on the edge portions of the orifice plate 5, the force trying to generate the peeling is smaller in comparison with the conventional liquid discharge recording heads.

As a result of the above-mentioned temperature/humidity cycle test using the liquid discharge recording head according to this embodiment, it was found that, similar to the first and second embodiments, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved.

[Fourth Embodiment]

Figure 6:
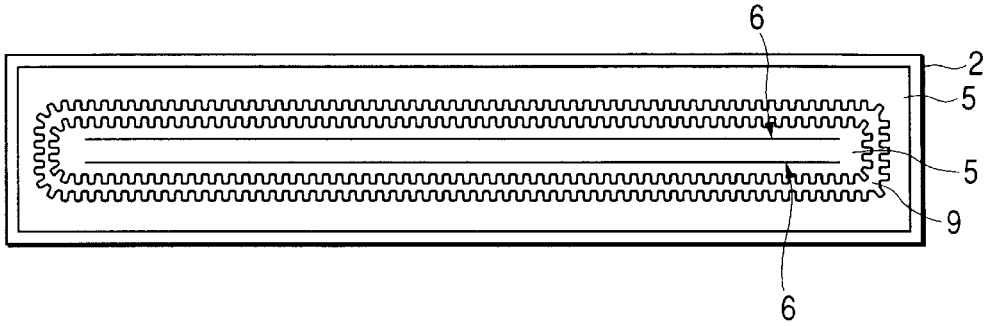
FIG. 6 is a plan view showing a liquid discharge recording head according to a fourth embodiment of the present invention.

FIG. 6 shows a liquid discharge recording head according to a fourth embodiment of the present invention. Incidentally, the same elements as those in the first to third embodiments are designated by the same reference numerals and explanation thereof will be omitted.

As shown in FIG. 6, the edge portions of the orifice plate 5 contacted with the groove 9 according to the fourth embodiment are formed as saw-shaped portions further rounded in comparison with the third embodiment. Also in the fourth embodiment, the stress components perpendicular to the edge portions of the orifice plate 5 are smaller than the stress P itself, with the result that the force trying to generate the peeling is smaller in comparison with the conventional liquid discharge recording heads.

When the edge portion of the orifice plate 5 is constituted by the rounded saw-shaped portion, since there is no corner portion (which is a base point for the peeling in the straight edge portion), the peeling is more hard to be occur, thereby preventing a bad influence from affecting upon the discharging performance.

As a result of the above-mentioned temperature/humidity cycle test using the liquid discharge recording head according to this embodiment, it was found that, similar to the first to third embodiments, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved.

[Fifth Embodiment]

Figure 7:
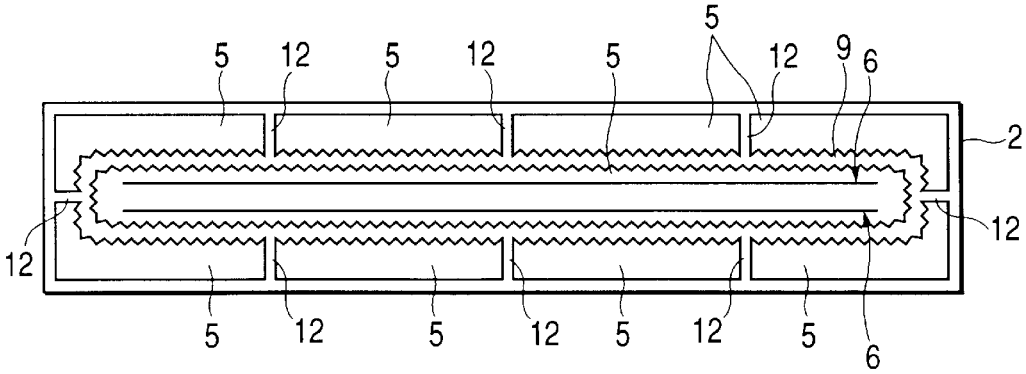
FIG. 7 is a plan view showing a liquid discharge recording head according to a fifth embodiment of the present invention.

FIG. 7 shows a liquid discharge recording head according to a fifth embodiment of the present invention. Incidentally, the same elements as those in the first to fourth embodiments are designated by the same reference numerals and explanation thereof will be omitted.

In the fifth embodiment, as shown in FIG. 7, an orifice plate portion (coat resin layer) 5 disposed outside of the groove 9 is divided into plural regions by slits 12. As an example, the number of slits 12 is eight, so that the orifice plate portion 5 disposed outside of the groove 9 is divided into eight regions. Accordingly, the stress acting on the orifice plate portion 5 is also divided into eight, and the volume of the orifice plate becomes smaller here. Thus, the stress (including the force trying to generate the peeling) acting on each of the divided regions of the orifice plate 5 becomes smaller in comparison with the conventional cases. Therefore, in the liquid discharge recording head according to the illustrated embodiment, it is said that the peeling between the substrate 2 and the orifice plate 5 is hard to be occur or at least the peeling is hard to be progressed. Further, deformation of the substrate 2 due to the stress becomes smaller. Incidentally, in the illustrated embodiment, while an example that the groove 9 is formed as a saw-shaped portion was illustrated, it is important that the orifice plate is divided as mentioned above, and it is more preferable that such division in combined with the saw-shaped groove 9.

As a result of the above-mentioned temperature/humidity cycle test using the liquid discharge recording head according to this embodiment, it was found that, similar to the first to fourth embodiments, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved.

[Sixth to Eighth Embodiment]

Figure 8:
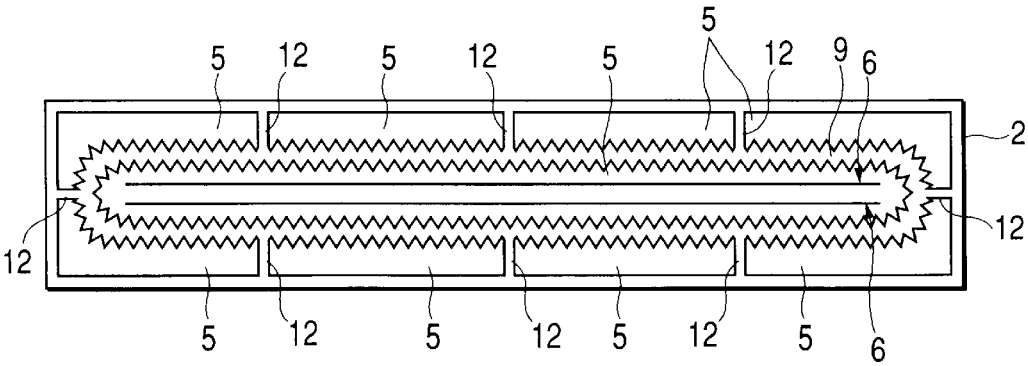
FIG. 8 is a plan view showing a liquid discharge recording head according to a sixth embodiment of the present invention.
Figure 9:
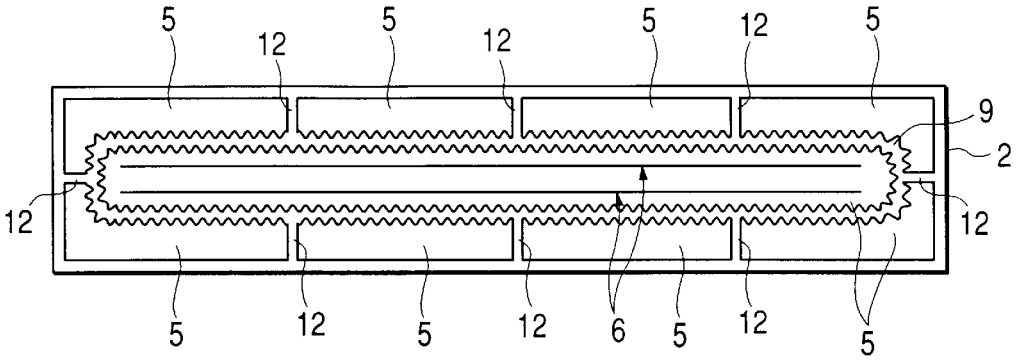
FIG. 9 is a plan view showing a liquid discharge recording head according to a seventh embodiment of the present invention.
Figure 10:
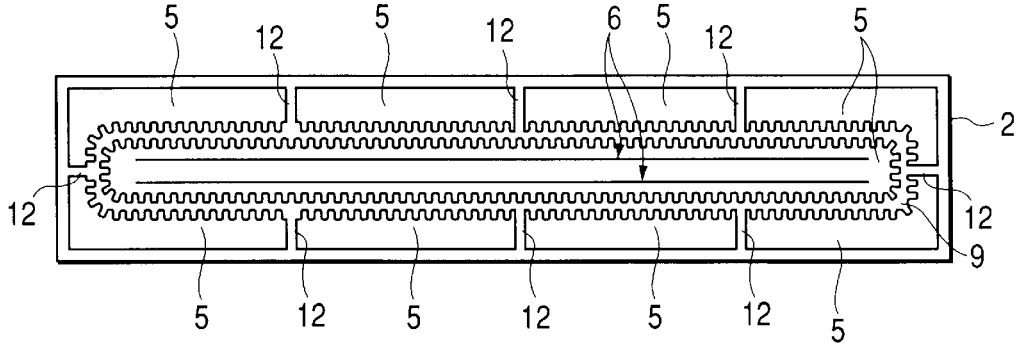
FIG. 10 is a plan view showing a liquid discharge recording head according to an eighth embodiment of the present invention.

FIGS. 8 to 10 show liquid discharge recording heads according to sixth to eighth embodiments of the present invention. Incidentally, the same elements as those in the first to fifth embodiments are designated by the same reference numerals and explanation thereof will be omitted.

In the sixth to eighth embodiments, similar to the fifth embodiment shown in FIG. 7, in an arrangement in which the orifice plate portion (coat resin layer) 5 is divided into plural regions by slits 12, indentation configurations of the edge portions of the orifice plate 5 contacted with the groove 9 are altered in various ways as described in the second to fourth embodiments.

As a result of the above-mentioned temperature/humidity cycle tests using the liquid discharge recording heads according to the sixth to eighth embodiments, it was found that, similar to the first to fifth embodiments, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved.

[Ninth Embodiment]

FIGS. 11A to 11C and FIG. 12 show a liquid discharge recording head according to a ninth embodiment of the present invention. Incidentally, the same elements as those in the first to eighth embodiments are designated by the same reference numerals and explanation thereof will be omitted.

Figure 11A:
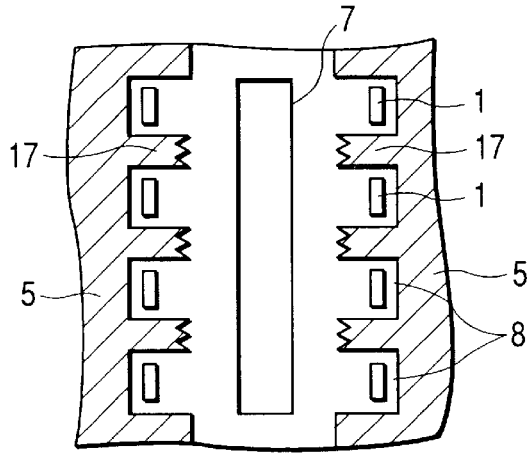
FIG. 11A is a plan view schematically showing a liquid discharge recording head according to a ninth embodiment of the present invention.
Figure 11B:
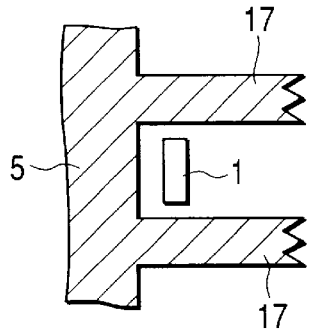
FIG. 11B is an enlarged view of a part thereof.
Figure 11C:
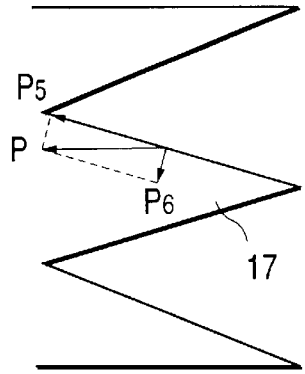
FIG. 11C is a further enlarged view of a part thereof.

In the ninth embodiment, in place of the fact that the edge portions of the orifice plate (coat resin layer) 5 contacted with the groove 9 are formed as the saw-shaped portions having minute indentations as is in the aforementioned embodiments, as shown in FIGS. 11A to 11C, edge portions (ink flow path walls 17) of the orifice plate 5 contacted with the ink flow path 8 are also formed as saw-shaped portions having minute indentations. Similar to the explanation in connection with the first embodiment, stress P acting on the edge portion (ink flow path wall 17) of the orifice plate 5 is divided into a stress component $P_5$ along the edge portion and a stress component $P_6$ perpendicular to the edge portion, and, since the force trying to generate the peeling is merely the stress component $P_6$, the force trying to generate the peeling becomes smaller in comparison with the conventional cases.

Figure 12:
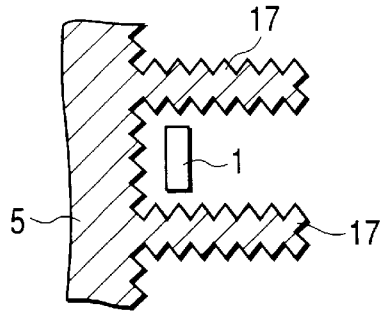
FIG. 12 is an enlarged plan view showing an alteration of the liquid discharge recording head according to the ninth embodiment.

As shown in FIGS. 11A to 11C, when the edge portions are formed as the saw-shaped portions at the thin side wall portions of the ink flow path 8 where the peeling is apt to occur, although the effect for preventing the peeling is enhanced, as shown in FIG. 12, at the entire contour of the ink flow path 8, the edge portions (ink flow path walls 17) of the orifice plate 5 contacted with the ink flow path 8 may be formed as rounded saw-shaped portions as is in the third and fourth embodiments. Also in this embodiment, it is preferable that the saw-shaped groove 9 as explained in connection with the first embodiment is added.

[Tenth Embodiment]

Figure 13A:
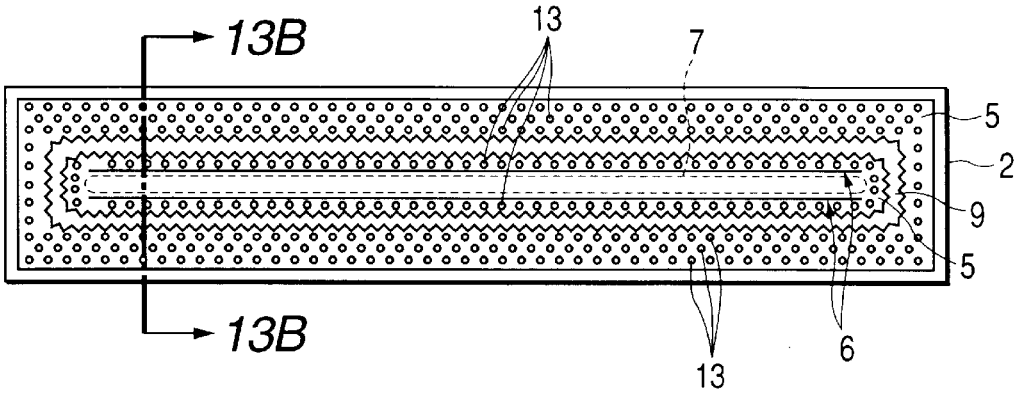
FIG. 13A is a plan view showing a liquid discharge recording head according to a tenth embodiment of the present invention.
Figure 13B:
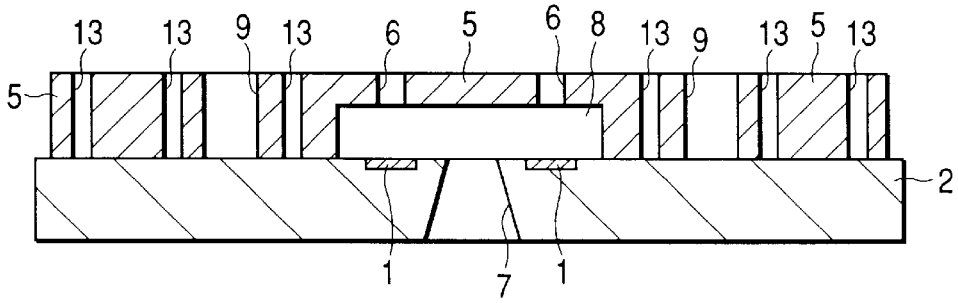
FIG. 13B is a sectional view taken along a line 13B—13B in FIG. 13A.

FIGS. 13A and 13B show a liquid discharge recording head according to a tenth embodiment of the present invention. Incidentally, the same elements as those in the first to ninth embodiments are designated by the same reference numerals and explanation thereof will be omitted.

In the tenth embodiment, as shown in FIGS. 13A and 13B, a number of through-holes 13 extending in a thickness direction are formed in the orifice plate 5. A cross-sectional shape of the through-holes 13 is circular or octagonal. Incidentally, the through-holes 13 are formed in an area except for the ink discharge ports 6 and the ink flow path 8 in the orifice plate portion 5 inside of the groove 9.

Since the volume of the orifice plate 5 is decreased due to the presence of the through-holes 13, the stress itself generated by hardening and thermal change of the resin is decreased, and, since the degree of freedom of deformation of the through-hole 13 is great, the stress can be relieved. That is to say, as shown in FIG. 13B (sectional view taken along the line 13B—13B in FIG. 13A), the through-holes 13 formed in the orifice plates 5 reach the substrate 2 and contribute to reduce the volume of the orifice plate 5, and, since the coat resin constituting the orifice plate acts to expand and contract the through-holes 13 slightly, the expansion and contraction of the orifice plate 5 are absorbed by the deformation of the through-holes 13 (or wall surfaces of the through-holes 13), thereby relieving the stress. Accordingly, it is said that the peeling of the orifice plate 5 is hard to occur or at least the peeling is hard to be progressed. Further, the deformation of the substrate 2 due to the stress is small.

When the coat resin constituting the orifice plate 5 is photosensitive resin, the through-holes 13 can be formed simultaneously with the patterning of the ink discharge ports 6 or the opening portion 4, by using the same mask.

As a result of the above-mentioned temperature/humidity cycle test using the liquid discharge recording head according to this embodiment, it was found that, similar to the first to eighth embodiments, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved.

When the through-hole 13 is cylindrical, since there is no corner portion (which is a base point for the peeling in the straight edge portion), the peeling is more hard to be occur, thereby preventing a bad influence from affecting upon the discharging performance. Also in this embodiment, it is preferable that the saw-shaped groove 9 as explained in connection with the first embodiment is added.

[Eleventh Embodiment]

Figure 14:
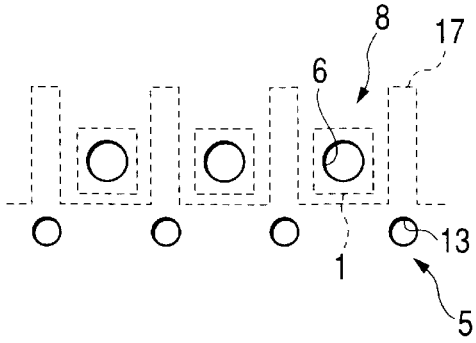
FIG. 14 is a partial enlarged plan view showing a liquid discharge recording head according to an eleventh embodiment of the present invention.

FIG. 14 shows a liquid discharge recording head according to an eleventh embodiment of the present invention. Incidentally, the same elements as those in the first to tenth embodiments are designated by the same reference numerals and explanation thereof will be omitted.

In the eleventh embodiment, particularly, through-holes 13 are formed in the orifice plate portion (coat resin layer) 5 disposed outside (rearwardly) of the ink flow path walls 17 flatly. Thus, the stress acting on areas in the vicinity of the ink discharge ports 6 can particularly be reduced, thereby providing a great effect for preventing deterioration of the printing property. Incidentally, similar to the tenth embodiment, a number of through-holes 13 are formed in the orifice plate portion 5 not shown in FIG. 14.

As a result of the above-mentioned temperature/humidity cycle test using the liquid discharge recording head according to this embodiment, it was found that, similar to the first to eighth embodiments and the tenth embodiment, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved. Also in this embodiment, it is preferable that the saw-shaped groove 9 as explained in connection with the first embodiment is added.

[Twelfth Embodiment]

Figure 15A:
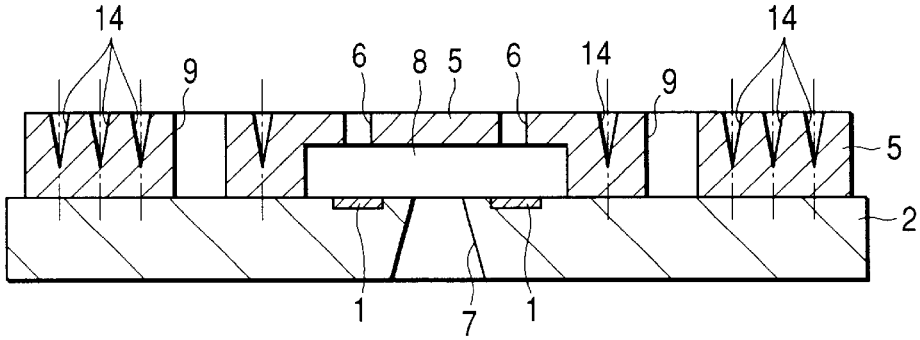
FIG. 15A is a sectional view showing a liquid discharge recording head according to a twelfth embodiment of the present invention.
Figure 15B:
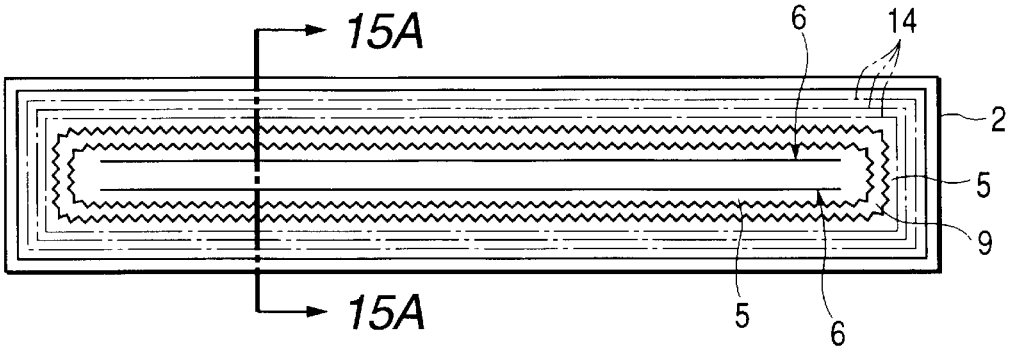
FIG. 15B is a plan view thereof.

FIGS. 15A and 15B show a liquid discharge recording head according to a twelfth embodiment of the present invention. Incidentally, the same elements as those in the first to eleventh embodiments are designated by the same reference numerals and explanation thereof will be omitted.

In the twelfth embodiment, as shown in FIGS. 15A and 15B, recessed grooves 14 not reaching the surface of the substrate 2 are formed in the orifice plate 5. Three rows of recessed grooves 14 are formed in the orifice plate portion outside of the groove 9 and a single row of recessed groove 14 are formed in the orifice plate portion inside of the groove 9, respectively. Incidentally, in FIG. 15B, for clarify's sake, only center lines of the recessed grooves 14 are shown as the two dot and chain lines.

Since the volume of the orifice plate 5 is reduced due to the presence of the recessed grooves 14, the stress itself generated by hardening and thermal change of the resin is decreased, and, since the degree of freedom of deformation of the recessed grooves 14 is great, the stress can be relieved. That is to say, each recessed groove 14 is formed obliquely from the surface of the orifice plate 5 to the surface of the substrate 2 and contributes to reduce the volume of the orifice plate 5, and, since the coat resin constituting the orifice plate acts to expand and contract the recessed grooves 14 slightly, the expansion and contraction of the orifice plate 5 are absorbed by the deformation of the recessed grooves (or wall surfaces of the recessed grooves 14), thereby relieving the stress. Accordingly, it is said that the peeling of the orifice plate 5 is hard to occur or at least the peeling is hard to be progressed. Further, the deformation of the substrate 2 due to the stress is small.

Further, since the recessed grooves 14 do not reach the substrate 2, the substrate 2 is not exposed, and, thus, the substrate 2 can be protected from being damaged during the handling such as actual mounting and assembling and be prevented from being damaged by sliding contact with the paper when the head is mounted to the printer.

When the coat resin constituting the orifice plate 5 is photo-sensitive resin, such recessed grooves 14 not reaching the substrate 2 can be formed simultaneously with the patterning of the ink discharge ports 6 or the opening portion 4 by using the same mask, by previously forming a fine pattern to the extent that the image is not deteriorated on the mask used in the formation of the ink discharge ports 6 or the opening portion 4.

As a result of the above-mentioned temperature/humidity cycle test using the liquid discharge recording head according to this embodiment, it was found that, similar to the first to eighth embodiments and the tenth and eleventh embodiment, the peeling of the edge portions of the orifice plate 5 contacted with the groove 9 does not occur al all or, if occurs, a level of such peeling does not arise any problem substantially, and, even when the recording is effected before and after the temperature/humidity cycle test, there is no change and good recording is achieved. Also in this embodiment, it is preferable that the saw-shaped groove 9 as explained in connection with the first embodiment is added.

[Thirteenth Embodiment]

Figure 16:
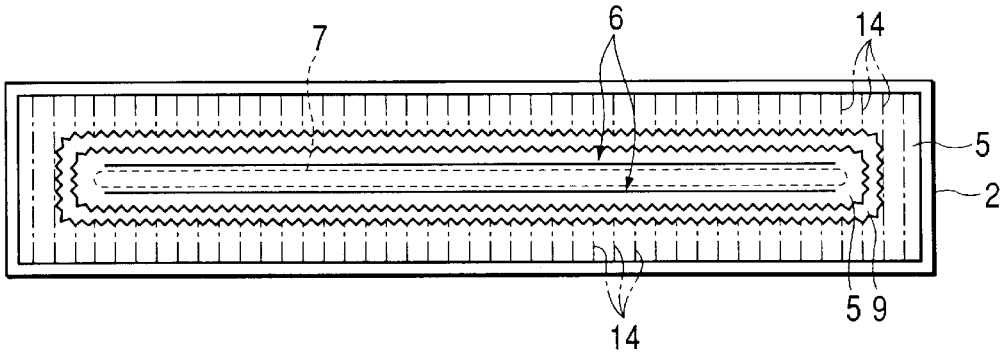
FIG. 16 is a plan view showing a liquid discharge recording head according to a thirteenth embodiment of the present invention.

FIG. 16 shows a liquid discharge recording head according to a thirteenth embodiment of the present invention. Incidentally, the same elements as those in the first to twelfth embodiments are designated by the same reference numerals and explanation thereof will be omitted. As shown in FIG. 16, in the thirteenth embodiment, plural rows of recessed grooves 14 having a strip shape in one direction and not reaching the substrate 2 are formed in the orifice plate portion (coat resin layer) 5 disposed outside of the groove 9.

As a result of the above-mentioned temperature/humidity cycle test using the liquid discharge recording head according to this embodiment, it was found that, similar to the first to eighth embodiments and the tenth to twelfth embodiment, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved. Also in this embodiment, it is preferable that the saw-shaped groove 9 as explained in connection with the first embodiment is added.

[Fourteenth Embodiment]

Figure 17A:
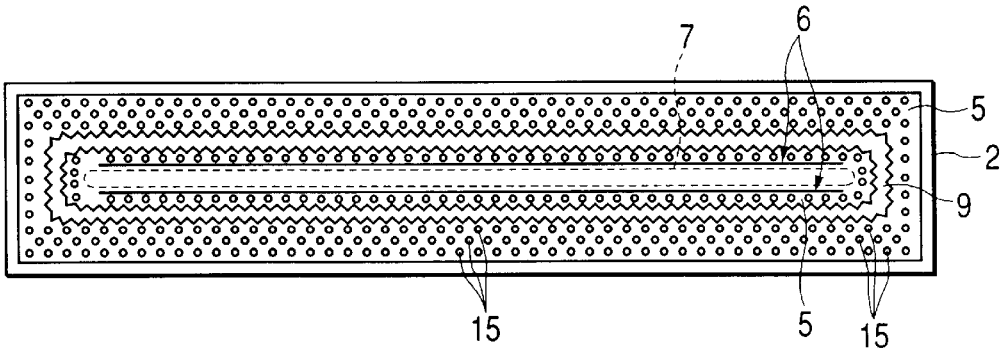
FIG. 17A is a plan view showing a liquid discharge recording head according to a fourteenth embodiment of the present invention.
Figure 17B:
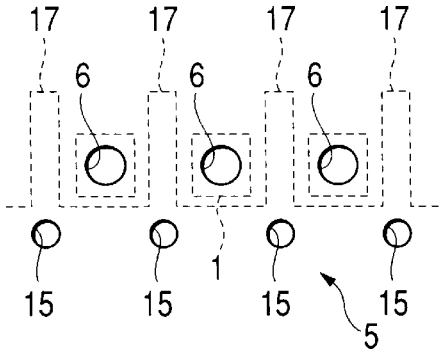
FIG. 17B is a partial enlarged view thereof.

FIGS. 17A and 17B show a liquid discharge recording head according to a fourteenth embodiment of the present invention. Incidentally, the same elements as those in the first to thirteenth embodiments are designated by the same reference numerals and explanation thereof will be omitted.

As shown in FIG. 17A, the orifice plate (coat resin layer) 5 according to the fourteenth embodiment is provided with a number of circular recessed portions 15 not reaching the substrate 2. Particularly, as shown in FIG. 17B as an enlarged view, the recessed portions 15 are provided in the orifice plate portion 5 disposed outside (rearwardly) of the ink flow path walls 17 flatly. Thus, the effect for preventing the peeling of the ink flow path walls 17 becomes great, and the stress acting on areas in the vicinity of the ink discharge ports 6 can be reduced, thereby providing a great effect for preventing deterioration of the printing property.

Since the recessed portion 15 is circular, there is no corner portion (which is a base point for the peeling in the straight edge portion) in the orifice plate 5, with the result that the peeling is more hard to be occur, thereby preventing a bad influence from affecting upon the discharging performance.

As a result of the above-mentioned temperature/humidity cycle test using the liquid discharge recording head according to this embodiment, it was found that, similar to the first to eighth embodiments and the tenth to thirteenth embodiment, the peeling of the edge portions of the orifice plate 5 contacted with the groove 9 does not occur at all or, if occurs, a level of such peeling does not arise any problem substantially, and, even when the recording is effected before and after the temperature/humidity cycle test, there is no change and good recording is achieved. Also in this embodiment, it is preferable that the saw-shaped groove 9 as explained in connection with the first embodiment is added.

[Fifteenth Embodiment]

Figure 18:
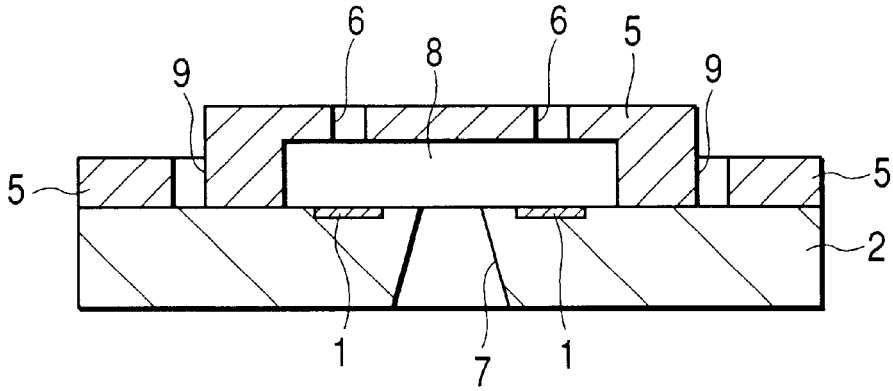
FIG. 18 is a sectional view showing a liquid discharge recording head according to a fifteenth embodiment of the present invention.

FIG. 18 shows a liquid discharge recording head according to a fifteenth embodiment of the present invention. Incidentally, the same elements as those in the first to fourteenth embodiments are designated by the same reference numerals and explanation thereof will be omitted.

In the fifteenth embodiment, in addition to the fact that the edge portions of the orifice plate (coat resin layer) 5 contacted with the groove 9 are formed as the saw-shaped portions having minute indentations as is in the aforementioned embodiments, the orifice plate portion 5 outside of the groove 9 is formed to be thinner than the orifice plate portion inside of the groove 9. With this arrangement, since the volume of the orifice plate portion 5 outside of the groove 9 is reduced, the stress itself generated by hardening and thermal change of the resin is decreased, and, it is said that the peeling of the orifice plate 5 is hard to occur particularly at the outside of the groove 9 or at least the peeling is hard to be progressed. Further, the deformation of the substrate 2 due to the stress is small. The thinning of the orifice plate portion 5 outside of the groove 9 can be effected by partial half etching. Also in this embodiment, it is preferable that the saw-shaped groove 9 as explained in connection with the first embodiment is added.

[Sixteenth Embodiment]

Figure 19:
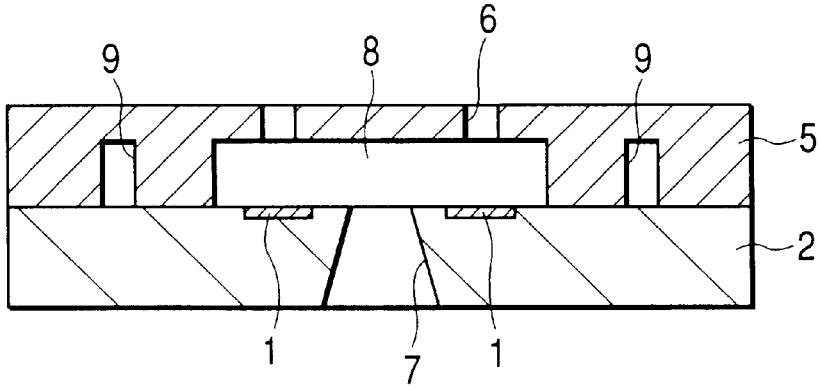
FIG. 19 is a sectional view showing a liquid discharge recording head according to a sixteenth embodiment of the present invention.
Figure 20B:
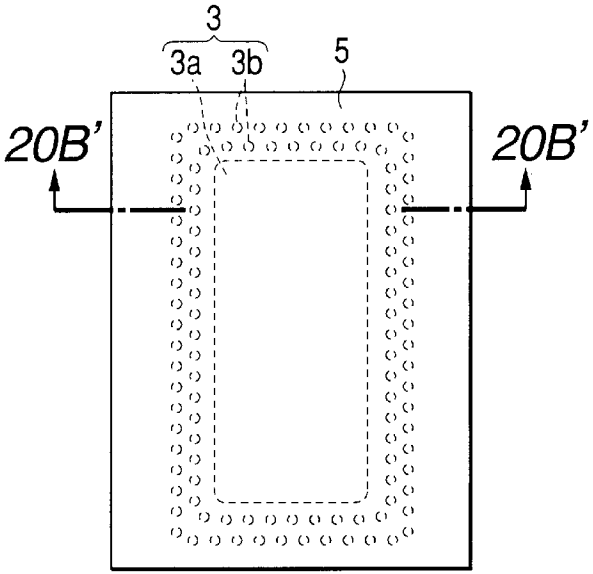
FIGS. 20A, 20B, 20C and 20D are plan views showing a liquid discharge recording head according to a seventeenth embodiment of the present invention, and FIGS. 20A', 20B', 20C' and 20D' are sectional views taken along lines of 20A'—20A', 20B'—20B', 20C'—20C' and 20D' to 20D', respectively.
Figure 20B:
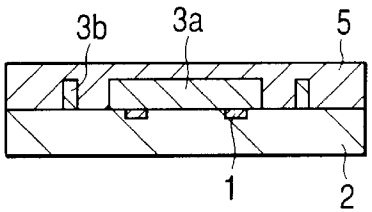
Figure 20A:
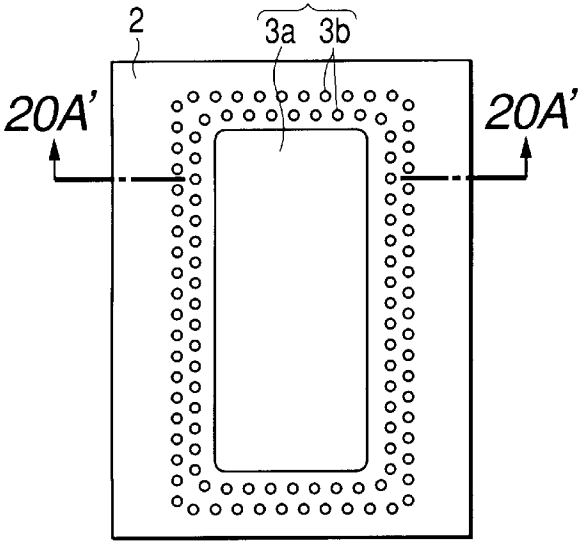
Figure 20A:
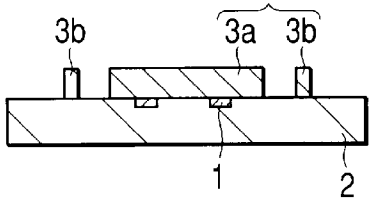
Figure 20D:
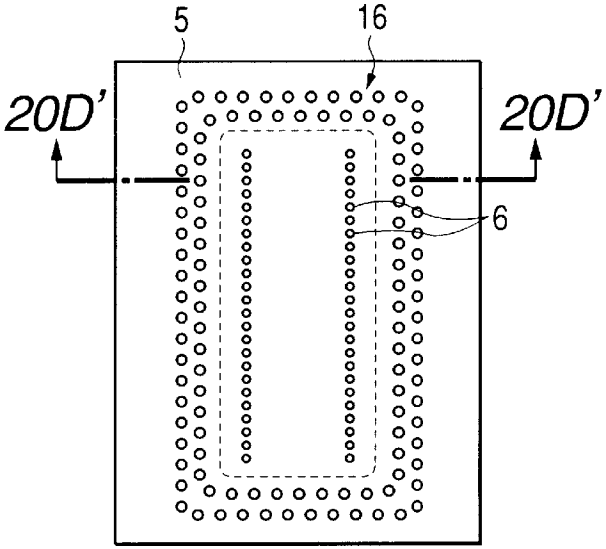
Figure 20D:
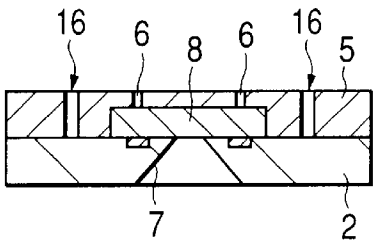
Figure 20C:
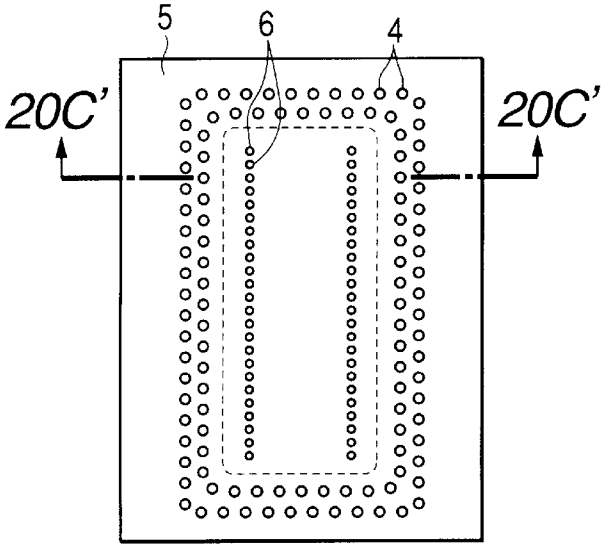
Figure 20C:
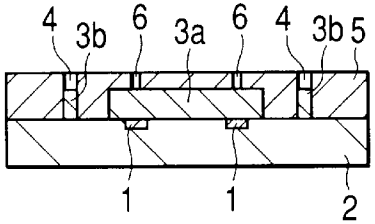
Figure 21B:
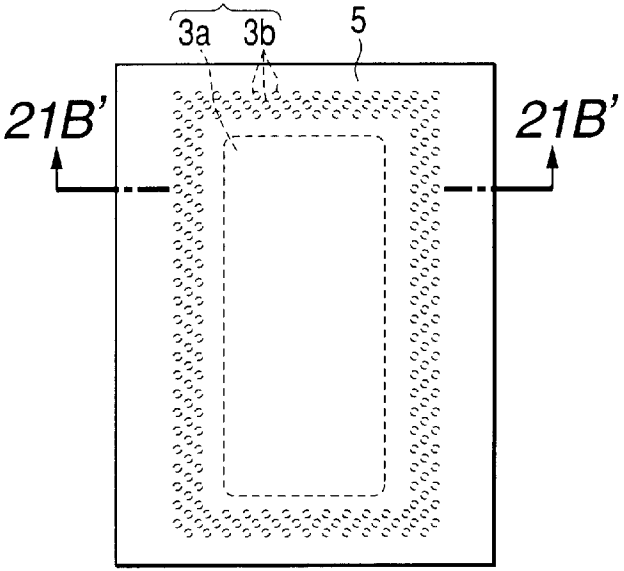
FIGS. 21A, 21B, 21C and 21D are plan views showing an alteration of the liquid discharge recording head according to the seventeenth embodiment of the present invention, and FIGS. 21A', 21B', 21C' and 21D' are sectional views taken along lines of 21A'—21A', 21B'—21B', 21C'—21C' and 21D'—21D', respectively.
Figure 21B:
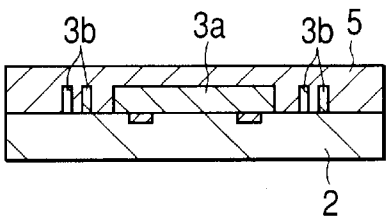
Figure 21A:
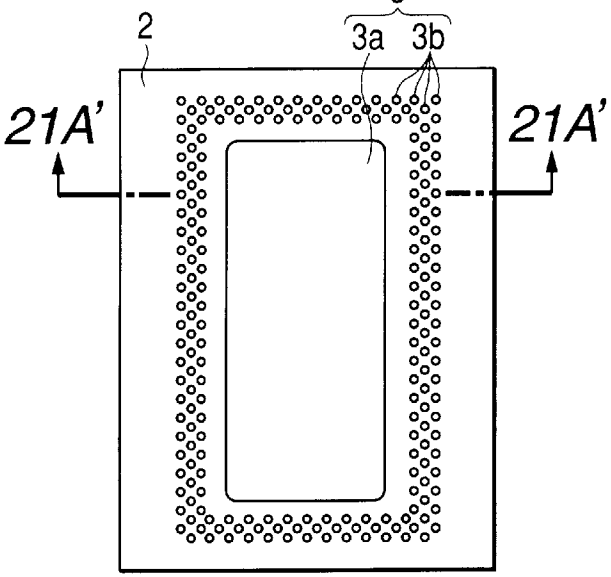
Figure 21A:
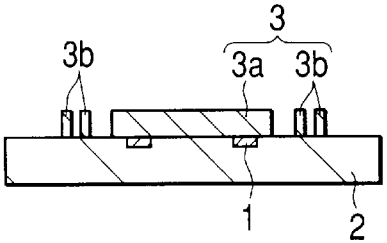
Figure 21D:
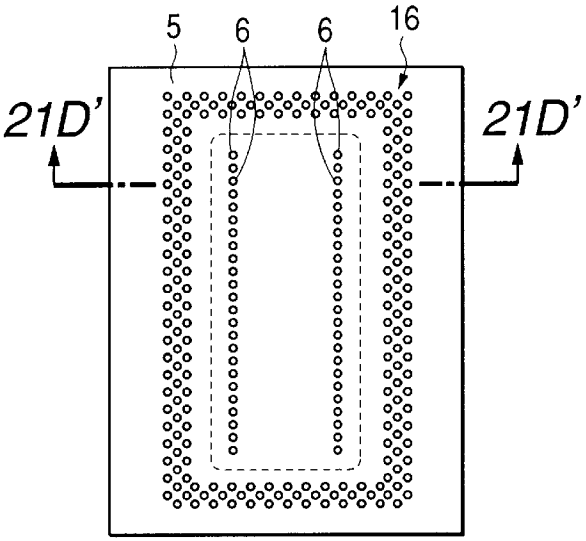
Figure 21D:
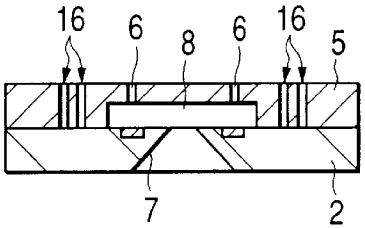
Figure 21C:
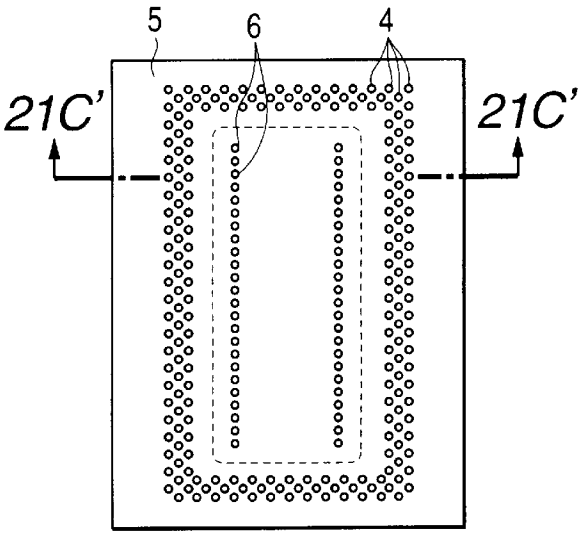
Figure 21C:
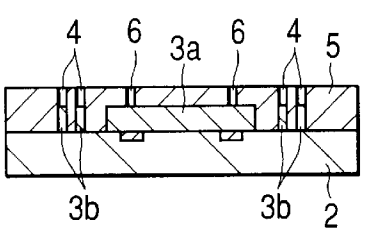
Figure 22A:
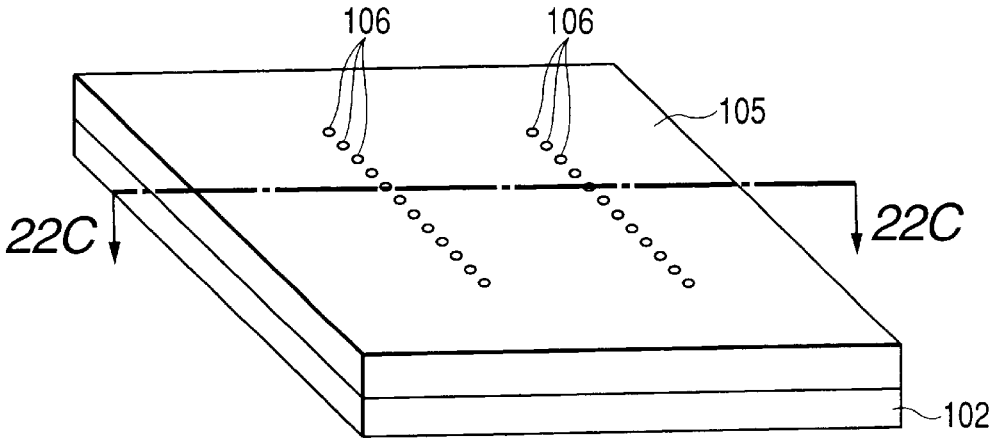
FIG. 22A PRIOR ART
FIG. 22A is a perspective view showing a first conventional liquid discharge recording head.
Figure 22B:
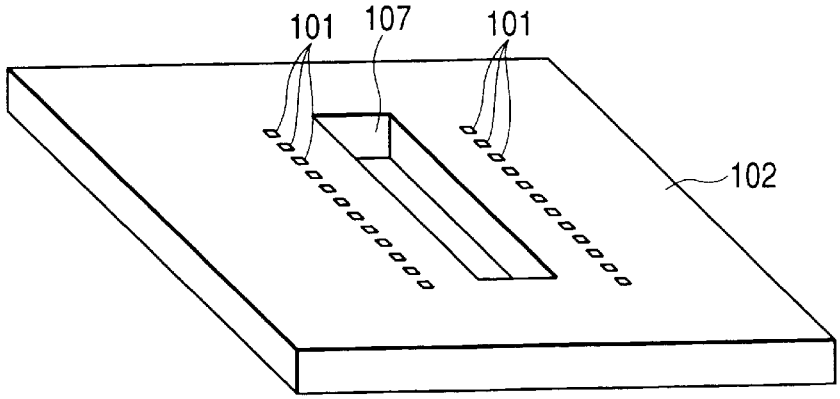
FIG. 22B PRIOR ART
FIG. 22B is a perspective view of a first conventional substrate.
Figure 22C:
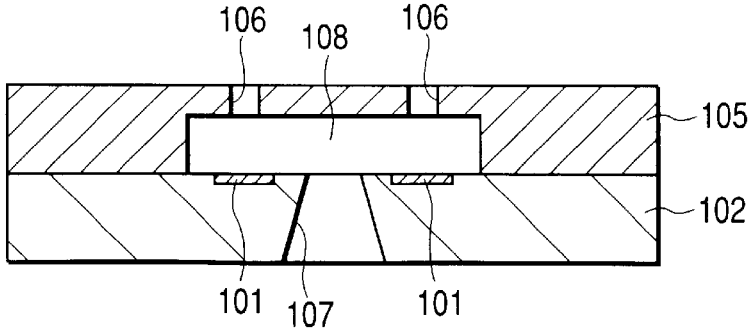
FIG. 22C PRIOR ART
FIG. 22C is a sectional view of the first conventional liquid discharge recording head, taken along a line 22C—22C in FIG. 22A.
Figure 23A:
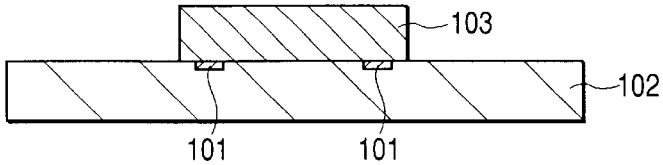
FIG. 23A PRIOR ART
FIGS. 23A, 23*b*, 23C and 23D are sectional views showing a method for manufacturing the first conventional liquid discharge recording head.
Figure 23B:
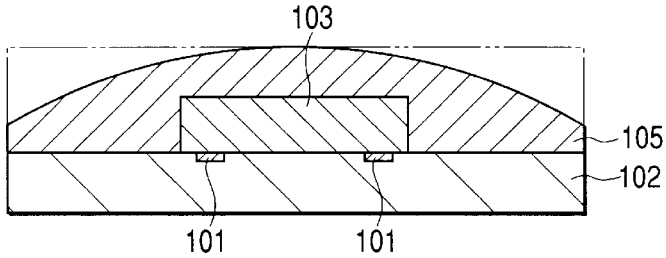
FIG. 23B PRIOR ART
Figure 23C:
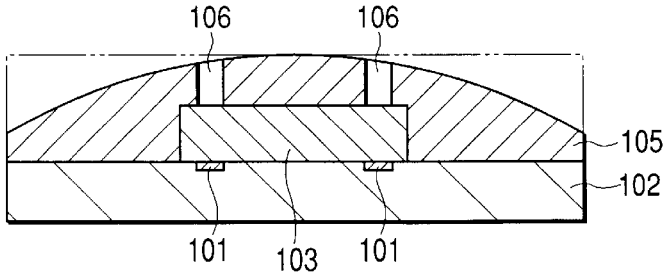
FIG. 23C PRIOR ART
Figure 23D:
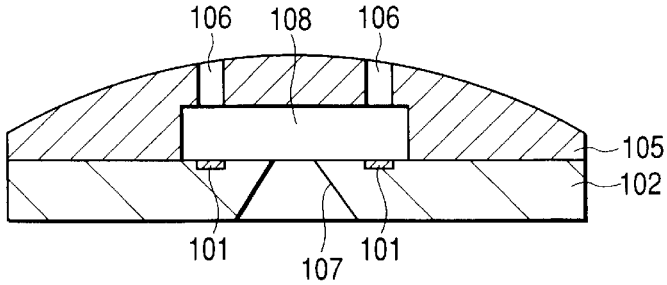
FIG. 23D PRIOR ART
Figure 24A:
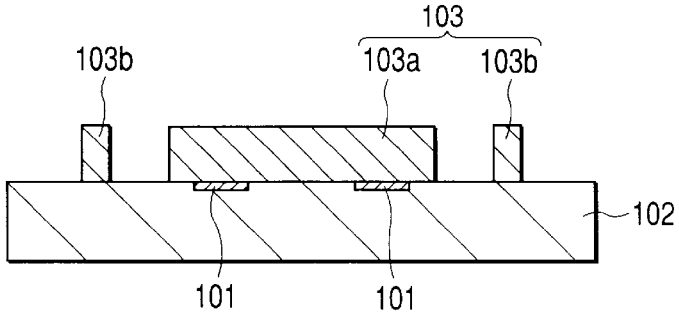
FIG. 24A PRIOR ART
FIGS. 24A, 24B, 24C and 24D are sectional views showing a method for manufacturing a second conventional liquid discharge recording head.
Figure 24B:
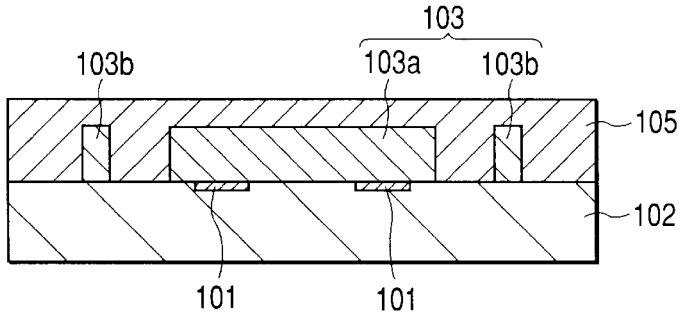
FIG. 24B PRIOR ART
Figure 24C:
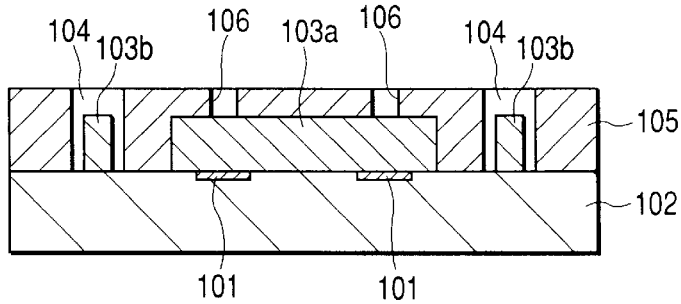
FIG. 24C PRIOR ART
Figure 24D:
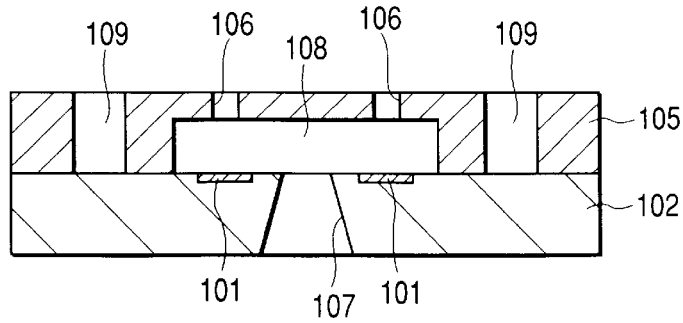
FIG. 24D PRIOR ART

FIG. 19 shows a liquid discharge recording head according to a sixteenth embodiment of the present invention. Incidentally, the same elements as those in the first to fifteenth embodiments are designated by the same reference numerals and explanation thereof will be omitted.

In the sixteenth embodiment, in addition to the fact that the edge portions of the orifice plate (coat resin layer) 5 contacted with the groove 9 are formed as the saw-shaped portions having minute indentations, an area above the groove 9 is covered by the orifice plate 5. That is to say, in manufacturing method for the liquid discharge recording head, the opening portion 4 to be formed in the coat resin layer 5 is formed at only a part of the portion constituting the groove 9 later, and the coat resin layer 5 is remained at the other portions. By pouring etching liquid from this small opening portion, the pattern 3*b* of the soluble resin layer 3 constituting the foundation is completely removed, and the groove 9 is formed in the manner similar to the aforementioned embodiments. However, there is the coat resin layer (orifice plate) 5 as a ceiling above the groove 9 through a substantially whole area, except for the small opening portion. Since the orifice plate 5 above the groove 9 acts as a bridge for transferring the stress, the stress can be prevented from being concentrated only on the edge portions of the orifice plate 5 contacted with the groove 9 to equilibrate the stress, thereby dispersing the force trying to generate the peeling thereby to make such force smaller. In this embodiment, further, it is preferable that the saw-shaped groove 9 as explained in connection with the first embodiment is added.

[Seventeenth Embodiment]

FIGS. 20A to 20D, 20A' to 20D', and FIGS. 21A to 21D, 21A' to 21D' show a liquid discharge recording head according to a seventeenth embodiment of the present invention. Incidentally, the same elements as those in the first to sixteenth embodiments are designated by the same reference numerals and explanation thereof will be omitted.

In the seventeenth embodiment, in place of the groove 9 in the aforementioned embodiments, hole arrays 16 including a number of holes and encircling the ink flow path similar to the groove 9 are provided. That is to say, as shown in FIGS. 20A to 20D', in the manufacturing steps for the liquid discharge recording head, among the soluble resin layer 3, as the pattern 3*b* constituting the foundation, cylinder arrays including a number of small cylinders are formed. And, after the coat resin layer 5 as the orifice plate is formed, the ink discharge ports 6 and the opening portion 4 are formed, and then, by pouring etching liquid from the ink discharge ports 6 and the opening portion 4, the soluble resin layer 3 is removed. In the illustrated embodiment, the pattern 3*b* constituting the foundation is formed as the cylinder arrays around which the coat resin is formed. Accordingly, when the soluble resin layer 3 is removed, the hole arrays 16 comprised of a number of small cylindrical holes are formed. The hole arrays 16 have the same function as the groove 9 having the saw-shaped contour in the aforementioned embodiments, so that the orifice plate 5 can be formed flatly and the small liquid droplet recording can be performed stably, and the stress acting the small liquid droplet recording can be performed stably, and the stress acting on the wall portions of the ink flow path 8 can be reduced as small as possible and the surface of the substrate 2 can be prevented from being damaged, and the peeling of the orifice plate 5 from the substrate 2 can be suppressed.

When recording was effected by using the liquid discharge recording head having two rows of staggered hole arrays 16 according to the illustrated embodiment (refer to FIGS. 20A to 20D') under a condition that discharging frequency f is 15 kHz and ink liquid comprised of pure water/diethylene glycol/isopropyl alcohol lithium acetate/black dye food black 2=79.4/15/3/0.1/2.5 is used, it was found that very high quality recording can be achieved. Further, supposing that the liquid discharge recording head is to be used for a long term, a continuous recording endurance test with f=15 kHz was effected. As a result, it was found that, even after the recording was performed greater than 10 times of practical conditions, the bad influence affecting upon the discharging property cannot be found at all and the good recording can be achieved.

As comparison, the test was effected by using the conventional liquid discharge recording head shown in FIGS. 25A to 25C (width of nozzle array=1 inch, similar to the illustrated embodiment of the present invention). When the continuous recording endurance test was effected by using this conventional liquid discharge recording head under a condition that f is 15 kHz and the aforementioned ink liquid is used, it was found that, after the number of recorded prints exceeds several times of the practical conditions, some of nozzles cannot discharge the ink liquid toward the recording medium at all to create stripes on the recording medium and/or thinning of image due to the ink discharged amount smaller than a design value, thereby providing low quality recording. Further, by observing the decomposed conventional liquid discharge recording head, it was found that there are zones where the orifice plate 105 is peeled from the substrate 2 around the opening portion for removing the pattern constituting the foundation.

Further, as a result of the similar recording test and continuous recording endurance test by using the liquid discharge recording head having three rows of staggered hole arrays according to the illustrated embodiment (refer to FIGS. 21A to 21D'), it was found that the good recording can be achieved similar to the above.

The present invention explained to connection with the aforementioned embodiments permits to provide a liquid discharge recording head of side shooter type in which, even when it is long, the orifice plate is not peeled from the substrate around the edge portions contacted with the groove and which has excellent endurance and high reliability, and a method for manufacturing such a liquid discharge recording head.

In the illustrated embodiment, when each hole constituting the hole array 16 is cylindrical, since there is no corner portion (which is a base point for the peeling) in the orifice plate 5, the peeling is more hard to be occur, thereby preventing a bad influence from affecting upon the discharging performance.

While various embodiments were explained, the present invention achieves the effects not only in each of the embodiments but also in any combinations of the embodiments.

The present invention explained in connection with the aforementioned embodiments provides excellent effects also in a liquid discharge recording head of piezo-electric type, as well as the above-mentioned liquid discharge recording head of bubble jet type. Particularly, it is effective that the present invention is applied to the recording heads disclosed in the aforementioned Japanese Patent Application Laid-open Nos. 4-10940, 4-10941 and 4-10942. By such application, a small ink droplet smaller than 50 pl can be discharged, and, since the ink liquid in front of the heat generating resistance body is discharged, the volume and speed of the ink droplet is not influenced by the temperature to be stabilized, thereby providing a high quality image.

The present invention is also effective to a recording head of full-line type in which simultaneous recording can be effected across the entire width of the recording paper and a color recording head having an arrangement in which a plurality of recording head portions are integrally formed or an arrangement in which a plurality of separately formed recording heads are combined.

What is claimed is:

1. A liquid discharge recording head comprising:

a substrate on which an energy generating element for generating liquid discharging energy is provided; and an orifice plate which is laminated with said substrate and in which a discharge port corresponding to said energy generating element is provided wherein a liquid droplet is discharged in a direction substantially perpendicular to surfaces of said substrate and said orifice plate, a flow path is formed between said substrate and said orifice plate, a groove encircling said flow path is formed in said orifice plate, and edge portions of said orifice plate contacted with said groove are formed to have a number of minute indentations.

2. A liquid discharge recording head according to claim 1, wherein said edge portions of said orifice plate contacted with said groove do not have continuously a portion perpendicular to a direction of stress acting on said edge portions.

3. A liquid discharge recording head according to claim 1, wherein said indentations provided on said edge portions of said orifice plate contacted with said groove are constituted by a combination of straight segments, and each of said straight segments does not have a portion perpendicular to a direction of stress acting on said edge portions.

4. A liquid discharge recording head according to claim 1, wherein said indentations provided on said edge portions of said orifice plate contacted with said groove are constituted by a combination of curved segments, and a line tangential to each of said curved segments does not have continuously a portion perpendicular to a direction of stress acting on said edge portions.

5. A liquid discharge recording head according to claim 1, wherein said indentations provided on said edge portions of said orifice plate contacted with said groove are constituted by a combination of straight segments and curved segments, and each of said straight segments does not have a portion perpendicular to a direction of stress acting on said edge portions and a line tangential to each of said curved segments does not have continuously a portion perpendicular to a direction of stress acting on said edge portions.

6. A liquid discharge recording head according to claim 1, wherein said edge portions of said orifice plate contacted with said groove are formed as saw-shaped portions.

7. A liquid discharge recording head comprising:

a substrate on which an energy generating element for generating liquid discharging energy is provided; and an orifice plate which is laminated with said substrate and in which a discharge port corresponding to said energy generating element is provided, wherein a liquid droplet is discharged in a direction substantially perpendicular to surfaces of said substrate and said orifice plate, a flow path is formed between said substrate and said orifice plate;

a groove encircling said flow path is formed in said orifice plate; and a portion of said orifice plate disposed outside of said groove is divided into plural regions.

8. A liquid discharge recording head comprising:

a substrate on which an energy generating element for generating liquid discharging energy is provided; and an orifice plate which is laminated with said substrate and in which a discharge port corresponding to said energy generating element is provided, wherein a liquid droplet is discharged in a direction substantially perpendicular to surfaces of said substrate and said orifice plate, a flow path is formed between said substrate and said orifice plate; and at least a part of edge portions of said orifice plate contacted with said flow path is formed as a saw-shaped portion having a number of minute indentations.

9. A liquid discharge recording head according to claim 8, wherein said at least a part of said edge portions of said orifice plate contacted with said flow path does not have continuously a portion perpendicular to a direction of stress acting on said edge portions.

10. A liquid discharge recording head comprising:

a substrate on which an energy generating element for generating liquid discharging energy is provided; and an orifice plate which is laminated with said substrate and in which a discharge port corresponding to said energy generating element is provided, wherein a liquid droplet is discharged in a direction substantially perpendicular to surfaces of said substrate and said orifice plate, a flow path is formed between said substrate and said orifice plate, and a plurality of through-holes reaching said substrate in a thickness direction are formed in a portion of said orifice plate other than said flow path.

11. A liquid discharge recording head comprising:

a substrate on which an energy generating element for generating liquid discharging energy is provided; and an orifice plate which is laminated with said substrate and in which a discharge port corresponding to said energy generating element is provided, wherein a liquid droplet is discharged in a direction substantially perpendicular to surfaces of said substrate and said orifice plate, a flow path is formed between said substrate and said orifice plate, and a plurality of recessed portions not reaching said substrate in a thickness direction are formed in a portion of said orifice plate other than said flow path.

12. A liquid discharge recording head according to claim 11, wherein said recessed portions are recessed grooves.

13. A liquid discharge recording head comprising:

a substrate on which an energy generating element for generating liquid discharging energy is provided; and an orifice plate which is laminated with said substrate and in which a discharge port corresponding to said energy generating element is provided, wherein a liquid droplet is discharged in a direction substantially perpendicular to surfaces of said substrate and said orifice plate, a flow path is formed between said substrate and said orifice plate, a groove encircling said flow path is formed in said orifice plate, and a portion of said orifice plate disposed outside of said groove has a thickness smaller than thicknesses of other portions of said orifice plate.

14. A liquid discharge recording head comprising:

a substrate on which an energy generating element for generating liquid discharging energy is provided; and an orifice plate which is laminated with said substrate and in which a discharge port corresponding to said energy generating element is provided, wherein a liquid droplet is discharged in a direction substantially perpendicular to surfaces of said substrate and said orifice plate, a flow path is formed between said substrate and said orifice plate;

a groove encircling said flow path is formed in said orifice plate, and said orifice plate has a ceiling portion covering a space above said groove.

15. A liquid discharge recording head comprising:

a substrate on which an energy generating element for generating liquid discharging energy is provided; and an orifice plate which is laminated with said substrate and in which a discharge port corresponding to said energy generating element is provided, wherein a liquid droplet is discharged in a direction substantially perpendicular to surfaces of said substrate and said orifice plate, a flow path is formed between said substrate and said orifice plate, and said orifice plate has a hole array including a plurality of holes and encircling said flow path.

16. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a configuration encircling said pattern constituting said flow path on a surface of said substrate on which said energy generating element is provided;

a step for forming a coat resin layer constituting said orifice plate on said substrate and said soluble resin layer; and a step for forming, by dissolving said soluble resin layer, said flow path in an area where said pattern constituting said flow path existed and a groove in an area where said pattern constituting said foundation existed, wherein edge portions of said pattern constituting said foundation are formed as saw-shaped portions having a number of minute indentations.

17. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a configuration encircling said pattern constituting said flow path on a surface of said substrate on which said energy generating element is provided;

a step for forming a coat resin layer constituting said orifice plate on said substrate and said soluble resin layer; and a step for forming, by dissolving said soluble resin layer, said flow path in an area where said pattern constituting said flow path existed and a groove in an area where said pattern constituting said foundation existed, wherein a portion of said orifice plate comprised of said coat resin layer disposed outside of the area where said flow path is to be formed is divided into plural regions.

18. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a configuration encircling said pattern constituting said flow path on a surface of said substrate on which said energy generating element is provided;

a step for forming a coat resin layer constituting said orifice plate on said substrate and said soluble resin layer; and a step for forming, by dissolving said soluble resin layer, said flow path in an area where said pattern constituting said flow path existed and a groove in an area where said pattern constituting said foundation existed, wherein at least a part of edge portions of said pattern constituting said flow path is formed as a saw-shaped portion having a number of minute indentations.

19. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a configuration encircling said pattern constituting said flow path on a surface of said substrate on which said energy generating element is provided;

a step for forming a coat resin layer constituting said orifice plate on said substrate and said soluble resin layer; and a step for forming, by dissolving said soluble resin layer, said flow path in an area where said pattern constituting said flow path existed and a groove in an area where said pattern constituting said foundation existed, wherein a portion of said orifice plate comprised of said coat resin layer other than the area where said flow path is to be formed is provided with a plurality of through-holes passing through a thickness direction of said orifice plate.

20. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a configuration encircling said pattern constituting said flow path on a surface of said substrate on which said energy generating element is provided;

a step for forming a coat resin layer constituting said orifice plate on said substrate and said soluble resin layer; and a step for forming, by dissolving said soluble resin layer, said flow path in an area where said pattern constituting said flow path existed and a groove in an area where said pattern constituting said foundation existed, wherein a portion of said orifice plate comprised of said coat resin layer other than the area where said flow path is to be formed is provided with a plurality of recessed portions not passing through a thickness direction of said orifice plate.

21. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a configuration encircling said pattern constituting said flow path on a surface of said substrate on which said energy generating element is provided;

a step for forming a coat resin layer constituting said orifice plate on said substrate and said soluble resin layer;

a step for forming, by dissolving said soluble resin layer, said flow path in an area where said pattern constituting said flow path existed and a groove in an area where said pattern constituting said foundation existed; and a step for reducing a thickness of a portion of said orifice plate comprised of said coat resin layer disposed outside of the area where said flow path is to be formed, by half etching.

22. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a configuration encircling said pattern constituting said flow path on a surface of said substrate on which said energy generating element is provided;

a step for forming a coat resin layer constituting said orifice plate on said substrate and said soluble resin layer; and a step for forming, by dissolving said soluble resin layer, said flow path in an area where said pattern constituting said flow path existed and a groove in an area where said pattern constituting said foundation existed, wherein a ceiling portion for said groove is formed by retaining at least a part of a portion covering a space above the area where said pattern constituting said foundation is to be formed on said coat resin layer constituting said orifice plate.

23. A method for manufacturing a liquid discharge recording head comprising a substrate on which an energy generating element for generating liquid discharging energy is provided and an orifice plate which is laminated with said substrate and in which a discharge port corresponding to said energy generating element is provided, and wherein a liquid droplet is discharged in a direction substantially perpendicular to surfaces of said substrate and said orifice plate, the method comprising:

a step for forming a soluble resin layer including a pattern constituting a flow path and a pattern constituting a foundation having a cylinder array configuration encircling said pattern constituting said flow path on a surface of said substrate on which said energy generating element is provided;

a step for forming a coat resin layer constituting said orifice plate on said substrate and said soluble resin layer; and a step for forming, by dissolving said soluble resin layer, said flow path in an area where said pattern constituting said flow path existed and a hole array in an area where said pattern constituting said foundation existed.

* * * * *

UNITED STATES PATENT AND TRADEMARK OFFICE

CERTIFICATE OF CORRECTION

PATENT NO. : 6,799,831 B2
DATED : October 5, 2004
INVENTOR(S) : Tadayoshi Inamoto et al.

It is certified that error appears in the above-identified patent and that said Letters Patent is hereby corrected as shown below:

Title page,
Item [56], References Cited, FOREIGN PATENT DOCUMENTS,
Insert -- JP 62-234941 10/1987
JP 4-10940 1/1992
JP 4-10941 1/1992
JP 4-10942 1/1922
JP 10-157150 6/1998
JP 11-138817 5/1999 --.

Column 1,
Line 26, "in perpendicular" should read -- perpendicularly --;
Line 53, "the both." should read -- both. --; and
Line 56, "increase the dimension" should read -- an increase in the dimensions of --.

Column 2,
Line 30, "is" should read -- are --.

Column 3,
Line 11, "patterned" should read -- patterned by --; and
Line 28, "so a large" should read -- so large an --.

Column 4,
Line 18, "prevent" should read -- prevented --;
Line 32, "small" should read -- much --; and
Line 35, "the above." should read -- above. --.

Column 5,
Line 6, "the peeling apt to be occurred." should read -- peeling is likely to occur. --;
Line 13, "acts" should read -- act --;
Line 31, "arise" should read -- arises --; and
Line 36, "worst" should read -- worse --.

Column 6,
Line 67, "was" should be deleted.

Column 7,
Line 2, 47 and 48, "was" should be deleted;
Line 19, "comprises" should read -- comprise --; and
Line 53, "arise" should read -- raise --.

UNITED STATES PATENT AND TRADEMARK OFFICE

CERTIFICATE OF CORRECTION

PATENT NO. : 6,799,831 B2
DATED : October 5, 2004
INVENTOR(S) : Tadayoshi Inamoto et al.

It is certified that error appears in the above-identified patent and that said Letters Patent is hereby corrected as shown below:

Column 9,
Line 58, "in" should read -- is --.

Column 10,
Line 16, "it is hard to occur the peeling or" should read -- the peeling is unlikely to occur. --;
Line 17, "the peeling is hard to be grown." should be deleted; and
Lines 23 and 33, "illustrate" should read -- illustrated --.

Column 11,
Line 32, "for" should read -- in --; and
Line 53, "form" should read -- from --.

Column 12,
Lines 13 and 46, "arise" should read -- raise --.

Column 13,
Line 25, "arise" should read -- raise --;
Line 48, "upon" should be deleted; and
Line 55, "if occurs," should read -- if it does occur, --; and "arise" should read -- raise --.

Column 14,
Line 11, "hard to be" should read -- unlikely to --;
Line 12, "is hard to be progressed" should read -- the peeling will not easily progress. --;
Line 18, "in" should read -- be --;
Line 24, "if occurs," should read -- if it does occur, --; and "arise" should read -- raise --;
Line 46, "if occurs," should read -- if it does occur --;
Line 47, "arise" should read -- raise --; and
Line 60, "is" should be deleted.

Column 15,
Line 13, "is" should be deleted;
Line 45, "hard" should read -- unlikely --; and "the peeling is hard to be" should read -- the peeling will not easily progress. --;
Line 46, "progressed." should be deleted;
Line 57, "if occurs," should read -- if it does occur, --; and "arise" should read -- raise --;
Line 63, "hard to be" should read -- unlikely to --; and
Line 64, "upon" should be deleted.

UNITED STATES PATENT AND TRADEMARK OFFICE

CERTIFICATE OF CORRECTION

PATENT NO. : 6,799,831 B2
DATED : October 5, 2004
INVENTOR(S) : Tadayoshi Inamoto et al.

It is certified that error appears in the above-identified patent and that said Letters Patent is hereby corrected as shown below:

Column 16,
Line 57, "hard" should read -- unlikely --; and "is" should be deleted; and
Line 58, "hard to be progressed" should read -- will not easily progress. --.

Column 17,
Line 12, "al" should read -- at --;
Lines 13 and 35, "arise" should read -- raise --;
Line 61, "hard to be" should read -- unlikely to --; and
Line 62, "upon" should be deleted.

Column 18,
Line 2, "arise" should read -- raise --;
Line 24, "hard" should read -- unlikely --;
Line 25, "is hard" should read -- the peeling will not easily progress. --; and
Line 46, "remained" should read -- remains --.

Column 19,
Line 23, "acting" should read -- acting on --;
Line 42, "upon" should be deleted; and
Line 55, "smaller" should read -- being smaller --.

Column 20,
Line 1, "to" should read -- in --;
Line 2, "to" should read -- one to --;
Line 12, "more hard" should read -- unlikely --;
Line 13, "upon" should be deleted; and
Line 32, "to" should read -- with --.

Signed and Sealed this

Twenty-third Day of August, 2005

JON W. DUDAS
*Director of the United States Patent and Trademark Office*